US010295303B2

(12) United States Patent
Buys

(10) Patent No.: US 10,295,303 B2
(45) Date of Patent: May 21, 2019

(54) PROJECTILE LAUNCHER

(71) Applicant: Tippmann Sports, LLC, Fort Wayne, IN (US)

(72) Inventor: Andre J. Buys, Pretoria (ZA)

(73) Assignee: Tippmann Sports, LLC, Fort Wayne, IN (US)

( * ) Notice: Subject to any disclaimer, the term of this patent is extended or adjusted under 35 U.S.C. 154(b) by 0 days.

(21) Appl. No.: 15/872,005

(22) Filed: Jan. 16, 2018

(65) Prior Publication Data

US 2018/0202752 A1 Jul. 19, 2018

Related U.S. Application Data

(60) Provisional application No. 62/445,991, filed on Jan. 13, 2017.

(51) Int. Cl.

| | |
|---|---|
| ***F41B 11/55*** | (2013.01) |
| ***F41B 11/62*** | (2013.01) |
| ***F41B 11/723*** | (2013.01) |
| *F41B 11/51* | (2013.01) |

(52) U.S. Cl.

CPC ..... *F41B 11/62* (2013.01); *F41B 11/55* (2013.01); *F41B 11/723* (2013.01); *F41B 11/51* (2013.01)

(58) Field of Classification Search

CPC ..... F41B 11/62
USPC ..... 42/73, 74
See application file for complete search history.

(56) References Cited

U.S. PATENT DOCUMENTS

| | | | | |
|---|---|---|---|---|
| 4,344,410 | A * | 8/1982 | Curran | F41B 11/62 124/74 |
| 5,711,286 | A | 1/1998 | Petrosvan et al. | |
| 6,029,645 | A * | 2/2000 | Wonisch | F41B 11/62 124/74 |
| 6,494,194 | B2 * | 12/2002 | Shipachev | F41A 9/76 124/31 |
| 7,290,539 | B2 | 11/2007 | Maeda et al. | |
| 7,600,509 | B2 | 10/2009 | Gabrel | |
| 7,730,882 | B2 * | 6/2010 | Liu | F41B 11/62 124/74 |
| 7,757,681 | B2 | 7/2010 | Gabrel | |
| 7,770,571 | B2 | 8/2010 | Tippmann, Jr. et al. | |
| 7,900,622 | B2 | 3/2011 | Douglas et al. | |
| 7,921,838 | B2 | 4/2011 | Tippmann, Jr. et al. | |

(Continued)

OTHER PUBLICATIONS

Tippmann; Tippmann M4 Carbine .68 Caliber Paintball Marker Owner's Manual; www.Tippmann.com; Ver. 07/16.

(Continued)

*Primary Examiner* — Reginald S Tillman, Jr.
(74) *Attorney, Agent, or Firm* — Barnes & Thornburg LLP

(57) ABSTRACT

A launcher for propelling projectiles out of a barrel using compressed gas. The receiver includes a grip with an opening for receiving a compressed gas cartridge. In some embodiments, the grip includes a door movable between an open position that allows the compressed gas cartridge to be removed from the opening, a closed position that retains the compressed gas cartridge in the opening, and an activation position where the door cooperates with a gas transfer mechanism to pierce the seal of the compressed gas cartridge to release gas. The door can be closed without piercing the seal, but a greater force can be applied to the door to pierce the seal.

15 Claims, 29 Drawing Sheets

(56) References Cited

U.S. PATENT DOCUMENTS

| | | | | |
|---|---|---|---|---|
| 8,146,580 | B2 * | 4/2012 | Wei | B25C 1/08 124/74 |
| 8,550,062 | B2 * | 10/2013 | Maeda | F41B 11/62 124/56 |
| 8,726,895 | B2 * | 5/2014 | Tippmann, Jr. | F41B 11/55 124/74 |
| 9,395,146 | B2 | 7/2016 | Tippmann, Jr. et al. | |
| 9,784,525 | B2 * | 10/2017 | Maeda | F41B 11/62 |
| 9,885,537 | B2 | 2/2018 | Tippmann, Jr. et al. | |
| 2002/0139362 | A1 | 10/2002 | Shipachev et al. | |

OTHER PUBLICATIONS

Tippmann; Tippmann M4 Carbine Low Energy Air Gun Owner's Manual; www.Tippmann.com; Rev. 02/15.

International Search Report and Written Opinion; App. No. PCT/US2018/013789; dated Jun. 18, 2018.

* cited by examiner

PROJECTILE LAUNCHER

RELATED APPLICATIONS

This application claims the benefit of U.S. Provisional Application Ser. No. 62/445,991 filed Jan. 13, 2017, which is hereby incorporated by reference in its entirety.

BACKGROUND

The present disclosure relates to projectile launchers, and particularly to projectile launchers for firing non-lethal projectiles. More particularly, the present disclosure relates to projectile launchers using a source of compressed gas to fire non-lethal projectiles.

SUMMARY

A projectile launcher in accordance with the present disclosure includes a receiver and a barrel coupled to the receiver. A source of compressed gas is coupled to the receiver to supply propellant gas for forcing a projectile out of the barrel.

In illustrative embodiments, a rear grip is coupled to the receiver. A cartridge handler retains a cartridge of compressed gas within the rear grip of the projectile launcher and is configured to selectively puncture the cartridge to supply compressed gas to the projectile launcher.

In illustrative embodiments, the barrel is rifled and ported along at least a portion of the rifling. A drill guide is used to align a drill bit positioned outside of the barrel with the rifling formed inside the barrel during formation of the ports.

In illustrative embodiments, a tank of compressed gas is coupled to a tank mount of the receiver. The tank at least partially defines a buttstock of the projectile launcher. A valve actuator is used to depress a valve stem of the tank to selectively supply compressed gas to the projectile launcher.

In illustrative embodiments, a projectile feeder of the receiver controls loading of a projectile into the barrel to minimize false-loading and wedging of the projectiles in a breech of the receiver.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
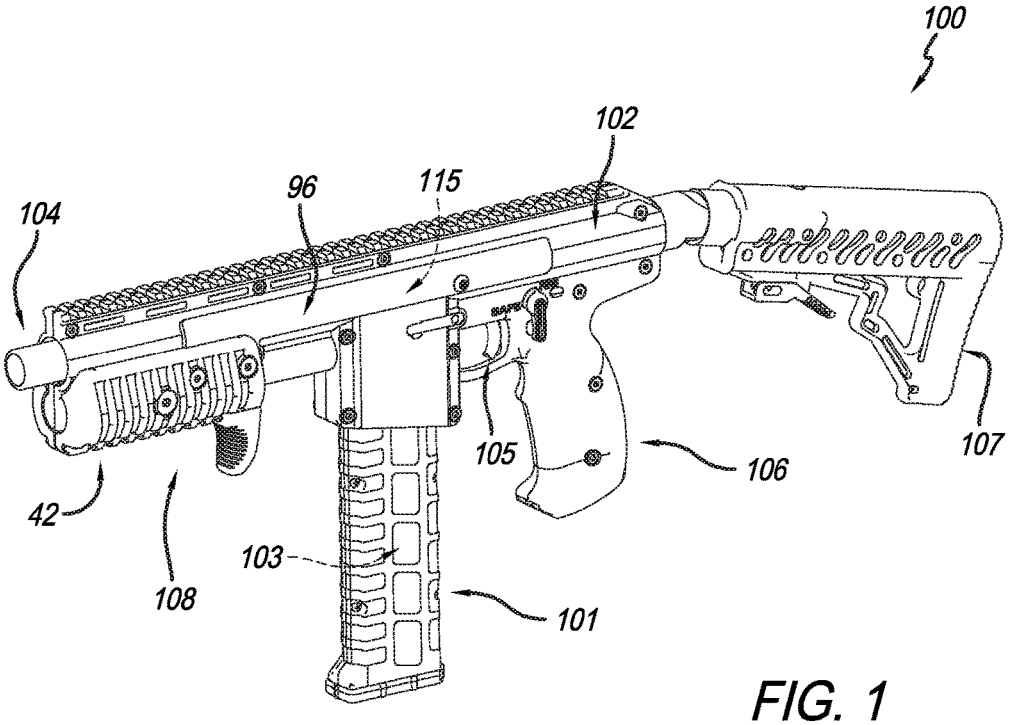
FIG. 1 is a side perspective view of one embodiment of a projectile launcher in accordance with the present disclosure showing that the projectile launcher includes a receiver and a barrel coupled to the receiver.
Figure 2:
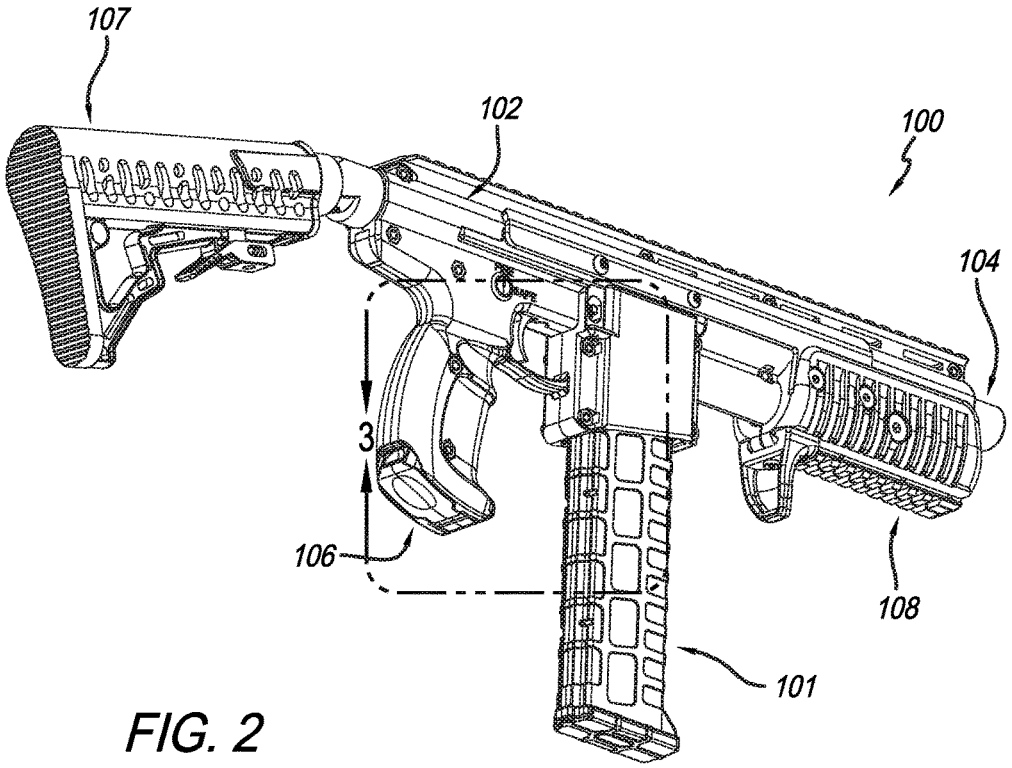
FIG. 2 is a lower perspective view of the projectile launcher of FIG. 1 showing that a rear grip is coupled to the receiver.

A projectile launcher 100 in accordance with the present disclosure is shown in FIGS. 1 and 2. In the illustrative embodiment, projectile launcher 100 includes a receiver 102 and a barrel 104 coupled to receiver 102. Receiver 102 is configured to accept a magazine 101 containing projectiles 103. In some embodiments, an internal or permanent magazine is used. A rear grip 106 and buttstock 107 are coupled to receiver 102 to maximize mobility and accuracy of projectile launcher 100.

A charging handle 108 is coupled to receiver 102 for loading projectiles 103 into barrel 104 after each shot as suggested in FIGS. 1 and 2. In some embodiments, an automatic loading mechanism is used. Projectiles 103 are launched from barrel 104 using compressed gas from a cartridge 16 as suggested in FIGS. 3 and 4. Charging handle 108 includes a fore-end grip 92 and a left-side connecting arm 96 as shown in FIG. 1. Left-side connecting arm 96 is coupled to fore-end grip 92 and a bolt 115. Bolt 115 moves inside receiver 102 to drive projectiles 103 into barrel 104 for launching. Compressed gas is supplied to bolt 115 to force projectile 103 out of barrel 104 after an operator of projectile launcher 100 pulls a trigger 105.

Figure 3:
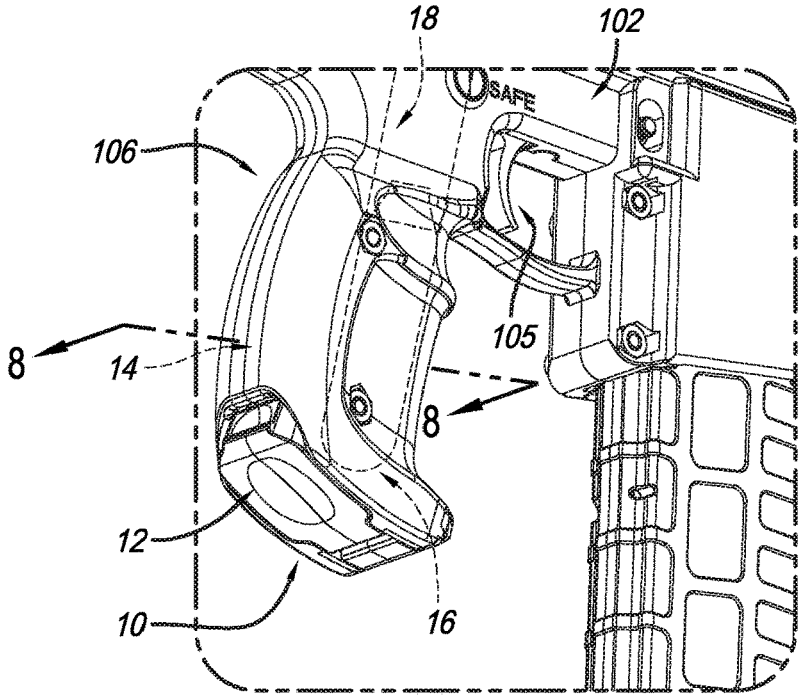
FIG. 3 is an enlarged view of FIG. 2 showing a cartridge of compressed gas stored within the rear grip and suggesting that a cartridge handler coupled to the rear grip is used to selectively block removal of the cartridge.
Figure 4:
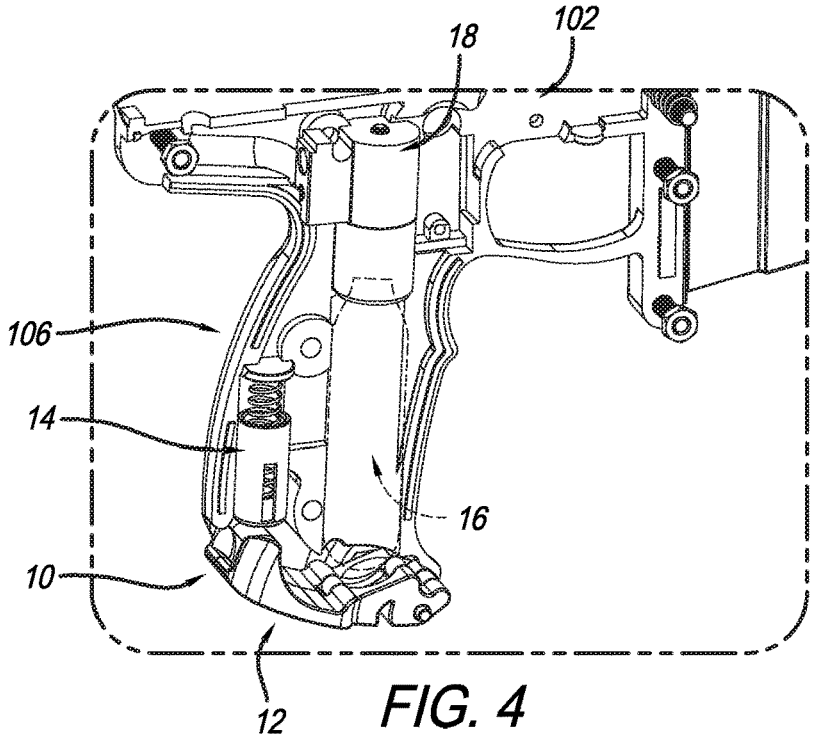
FIG. 4 is a view similar to FIG. 3 showing the rear grip with portions broken away and that the rear grip includes a selector and a retainer.

In the illustrative embodiment, a cartridge handler 10 in accordance with the present disclosure is coupled to rear grip 106 for loading, storing, and activating cartridge 16 as suggested in FIGS. 3 and 4. Cartridge handler 10 includes a selector 12 and a retainer 14. Selector 12 is configured to move cartridge 16 relative to a gas-transfer mechanism 18. Retainer 14 is configured to control movement of selector 12.

Figure 5:
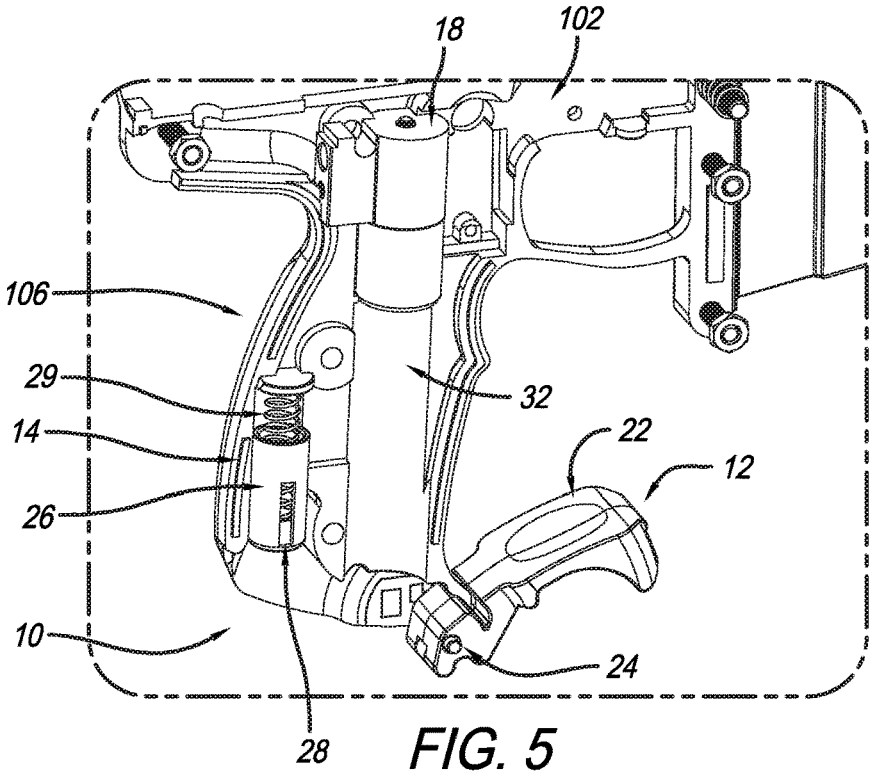
FIG. 5 is a view similar to FIG. 4 showing the selector in an open position spaced apart from a cartridge sleeve of the rear grip to allow a cartridge to be inserted into the rear grip as suggested in FIG. 6.

Selector 12 includes a door 22 and a pivot pin 24 as shown in FIG. 5. Pin 24 is coupled to rear grip 106 and door 22 is configured to pivot on pin 24 relative to rear grip 106. Selector 12 is shown in an open position in FIG. 5 where door 22 is spaced apart from a cartridge sleeve 32 of rear grip 106. Cartridge 16 is inserted into, or allowed to pass out of, cartridge sleeve 32 when selector 12 is in the open position as suggested in FIG. 6.

Figure 6:
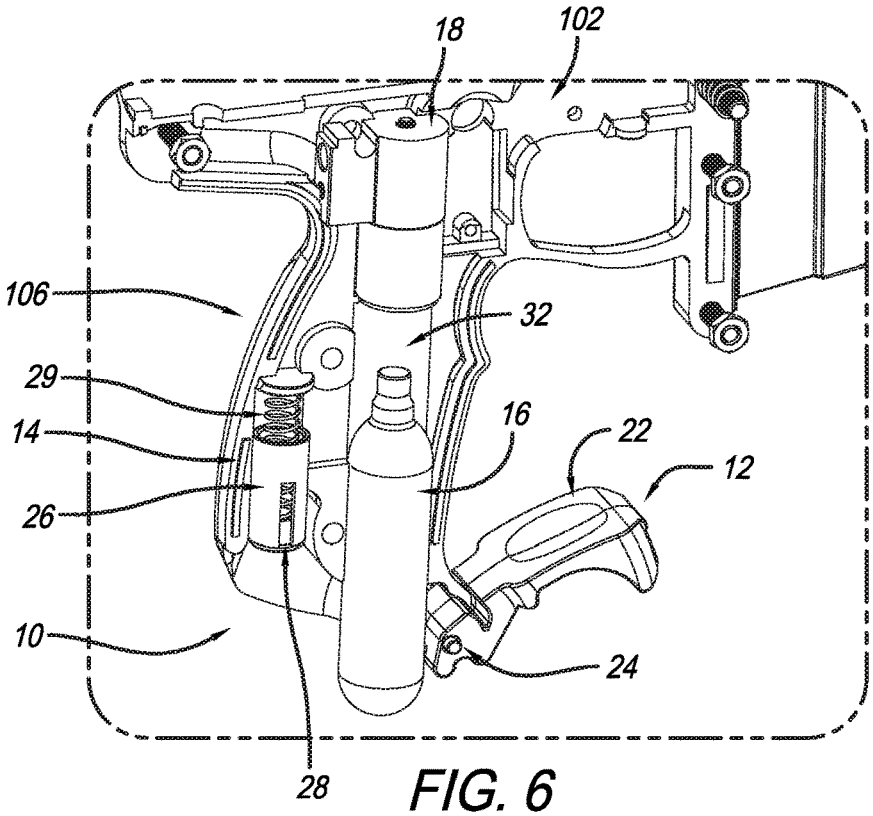
FIG. 6 is a view similar to FIG. 5 showing a cartridge partially inserted into the rear grip.
Figure 7:
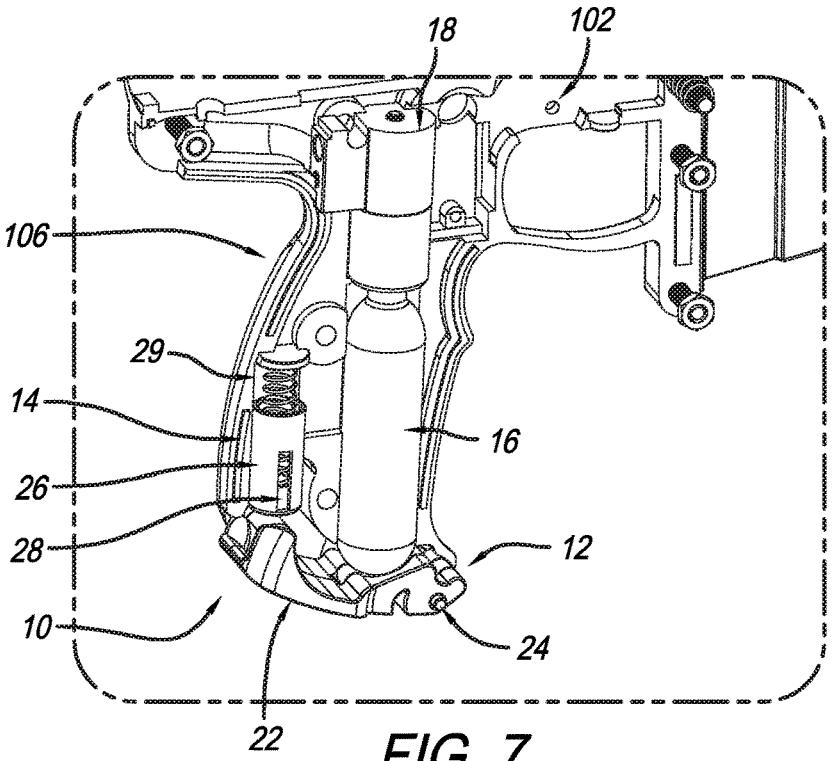
FIG. 7 is a view similar to FIG. 6 showing the cartridge positioned in the cartridge sleeve and suggesting that the selector has been pivoted to the closed position to engage with the retainer to hold the selector in the closed position prior to puncturing the cartridge.
Figure 8:
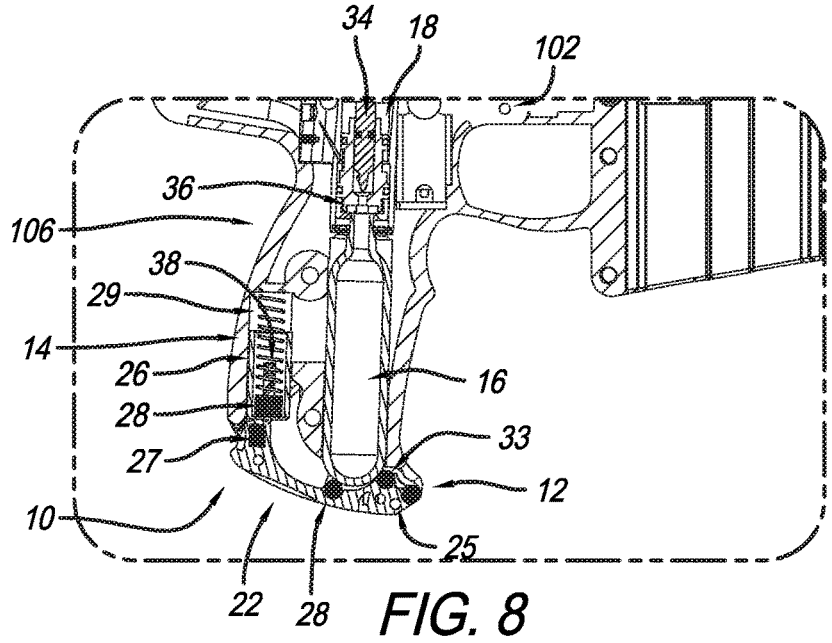
FIG. 8 is a sectional view taken along line 8-8 in FIG. 3 showing the cartridge at least partially received in a gas transfer mechanism and spaced apart from a puncture needle of the gas transfer mechanism after being inserted into the rear grip and suggesting that the cartridge is stored within the handle in a sealed state.

A sealed cartridge 16 is inserted into rear grip 106 as suggested in FIG. 6. Selector 12 is configured to move from the open position, shown in FIG. 6, to a closed position, shown in FIG. 7, without puncturing cartridge 16 with a puncture needle 34 of gas-transfer mechanism 18, as suggested in FIG. 8. In the illustrative embodiment, retainer 14 includes a guide tube 26, a magnet 28 coupled to guide tube 26, and a spring 29 as shown in FIG. 7. Spring 29 engages with rear grip 106 to bias magnet 28 away from gas-transfer mechanism 18. Magnet 28 is configured to hold selector 12 in the closed position prior to puncturing cartridge 16. In some embodiments, door 22 is formed of magnetic material. In some embodiments, a magnet 27 is coupled to door 22 to attract with magnet 28 as suggested in FIG. 8.

Figure 9:
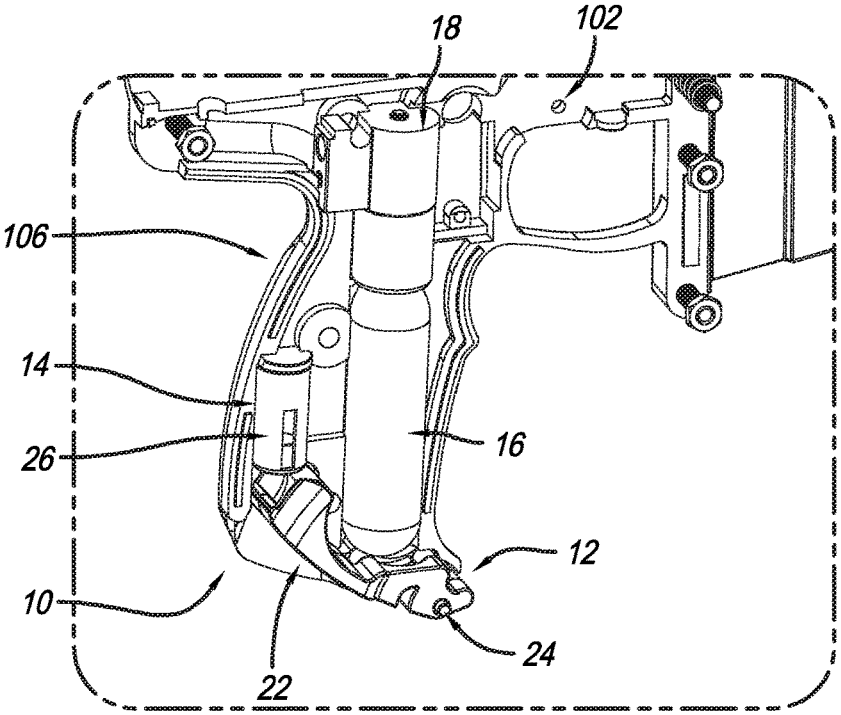
FIG. 9 is a view similar to FIG. 7 showing the cartridge moved further into the rear grip and into the gas transfer mechanism and suggesting that the selector is pivoted by an operator of the projectile launcher to an activation position to drive the cartridge into the gas transfer mechanism and puncture the cartridge as shown in FIG. 10.
Figure 10:
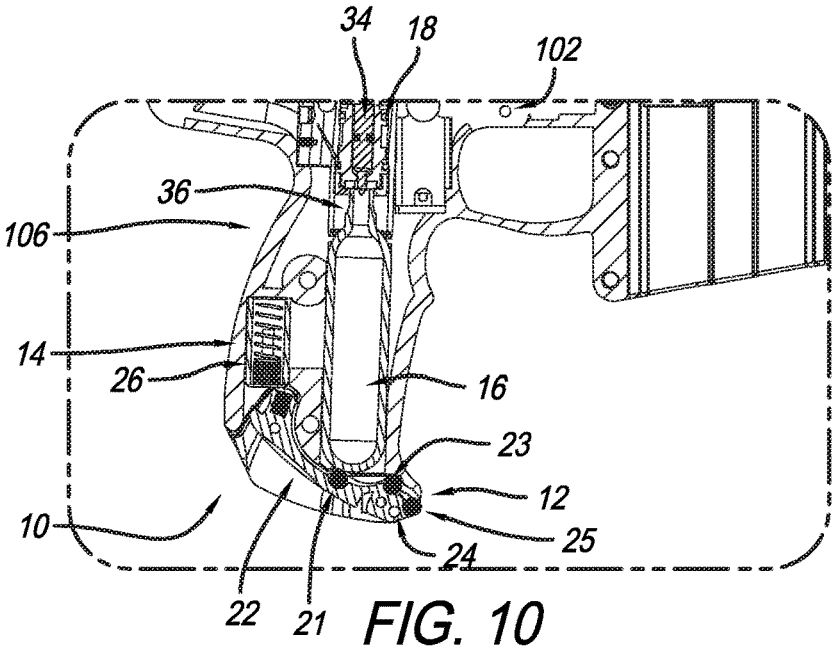
FIG. 10 is a view similar to FIG. 8 showing the puncture needle extending into the cartridge to open the cartridge and expose the compressed gases for use in the projectile launcher.

An operator moves selector 12 to an activation position, as shown in FIG. 9, to puncture cartridge 16 with needle 34, as suggested in FIG. 10. A first roller 21 coupled to door 22 engages with cartridge 16 to ease movement from the closed position to the activation position. A seal member 36 engages with cartridge 16 to form a seal and directs the compressed gases through gas-transfer mechanism 18 for use in projectile launcher 100. The compressed gases drive cartridge 16 toward selector 12 and moves selector 12 back to the closed position. A second roller 23 coupled to door 22 engages with cartridge 16 to bias door 22 away from the open position and toward the closed position as suggested in FIG. 8.

Figure 11:
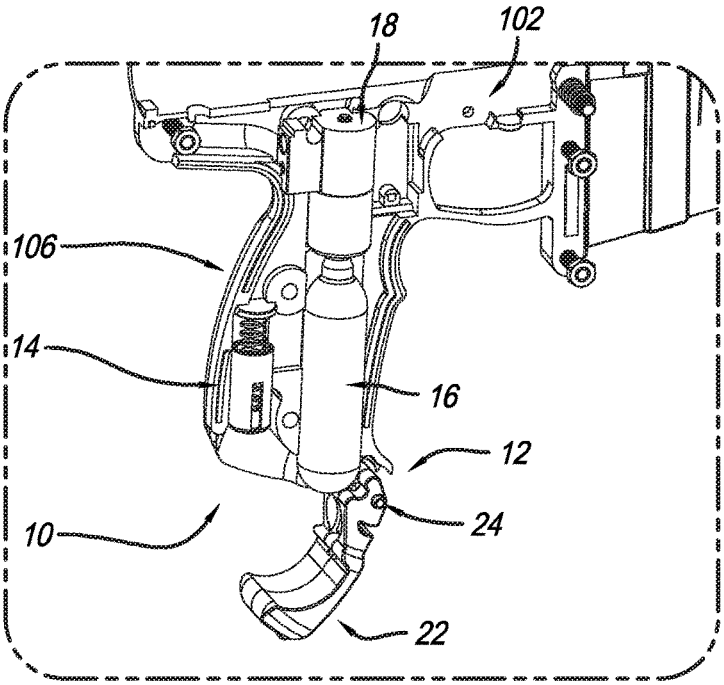
FIG. 11 is a view similar to FIG. 7 showing the selector in a venting position to allow unused gases from the cartridge to be vented prior to removal of the cartridge from the rear grip.
Figure 12:
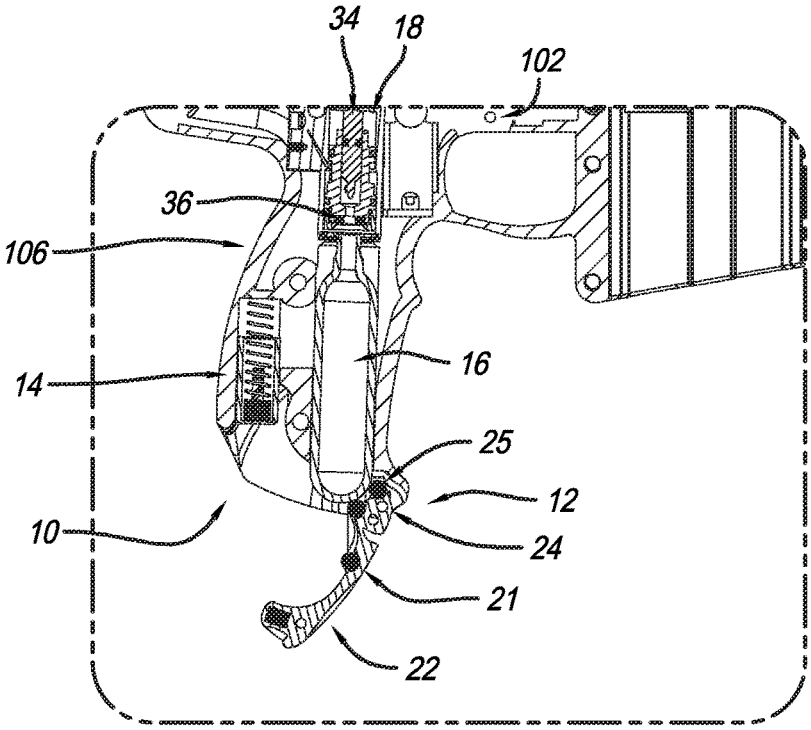
FIG. 12 is a view similar to FIG. 8 showing the cartridge engaged with a roller of the selector and suggesting that the compressed gases drive the cartridge toward the selector to bias the selector toward the closed position.

An operator moves selector 12 to the open position for removal of cartridge 16 when the compressed gases have been depleted as suggested in FIG. 6. In some instances, the compressed gases within cartridge 16 are not depleted upon removal of cartridge 16 from rear grip 106. An operator can move selector 12 to a venting position to allow residual gases to dissipate before removing cartridge 16 as suggested in FIG. 11. Cartridge 16 is spaced apart from seal member 36 when selector 12 is in the venting position to allow residual gases to flow out of cartridge 16. A third roller 25 coupled to door 22 engages with cartridge 16 to bias door 22 away from the open position and toward the venting position so that the force of the compressed gases does not drive cartridge 16 out of rear grip 106 as suggested in FIG. 12.

Figure 13:
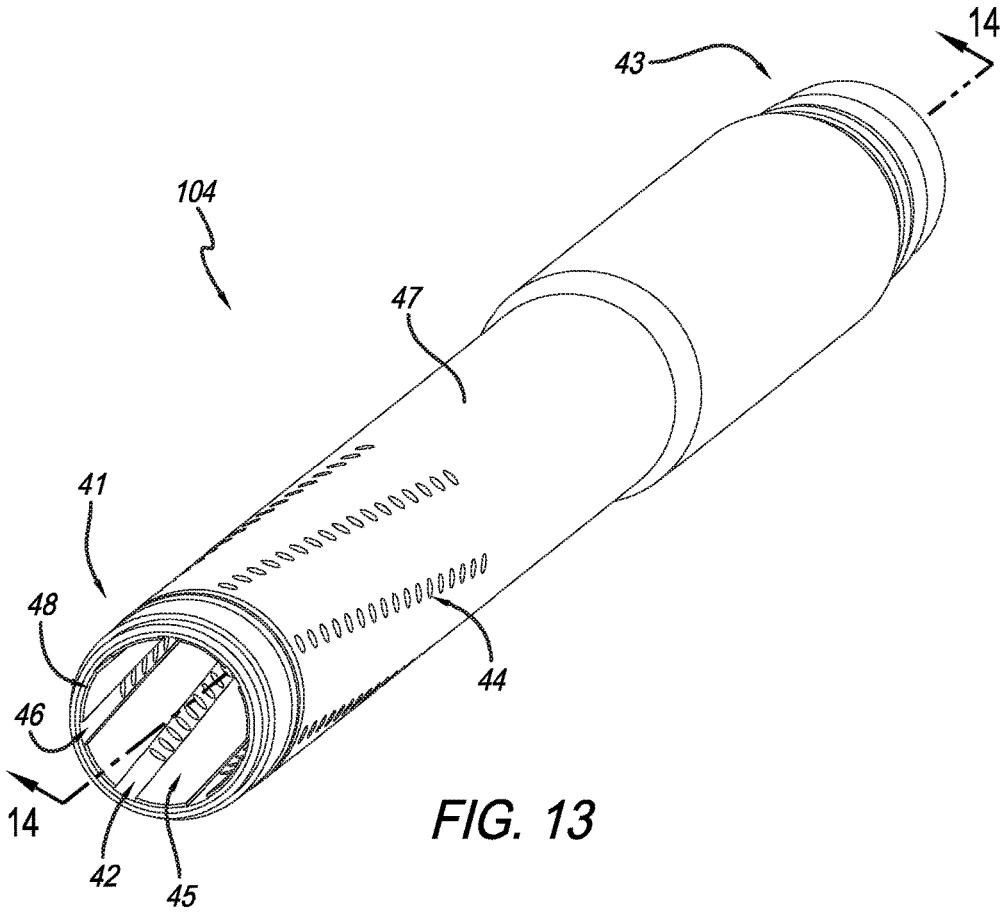
FIG. 13 is a perspective view of one embodiment of a barrel in accordance with the present disclosure showing that the barrel includes helical rifling and porting and suggesting that the porting is aligned with grooves of the rifling.
Figure 14:
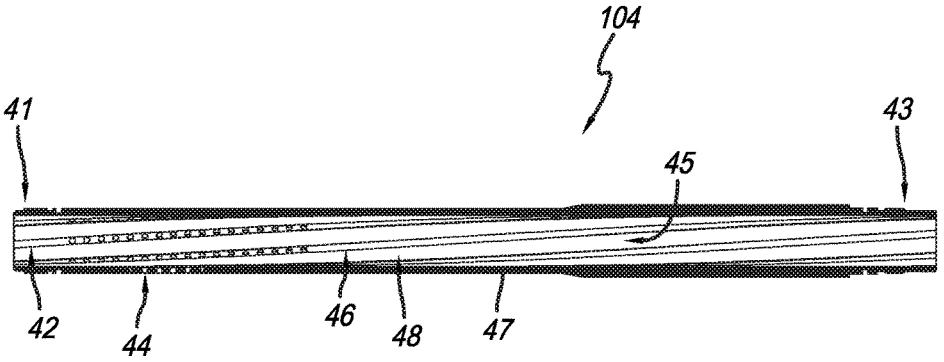
FIG. 14 is a sectional view taken along line 14-14 in FIG. 13 showing the rifling extending along substantially an entire length of the barrel and the porting extending partially along the length of the barrel from a muzzle end of the barrel.
Figure 15:
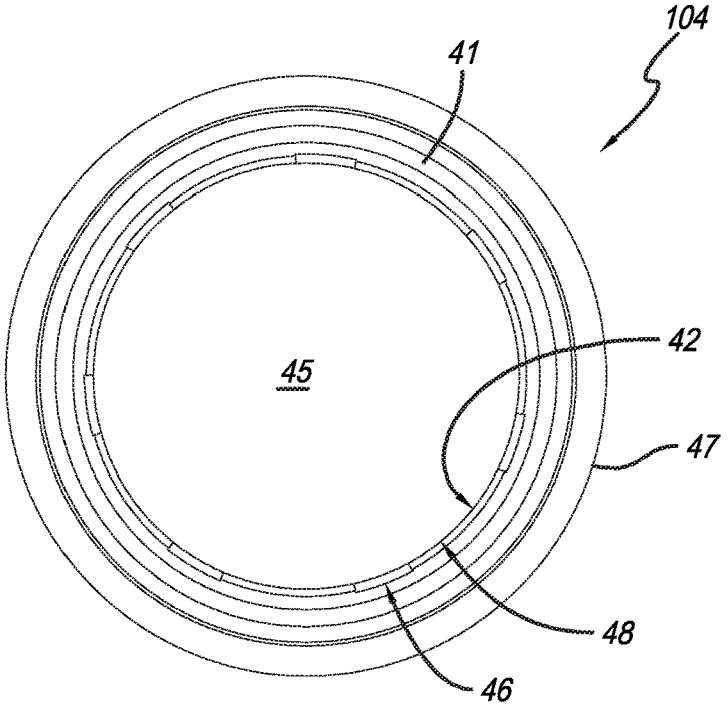
FIG. 15 is a front elevation view of the barrel of FIG. 13.
Figure 16:
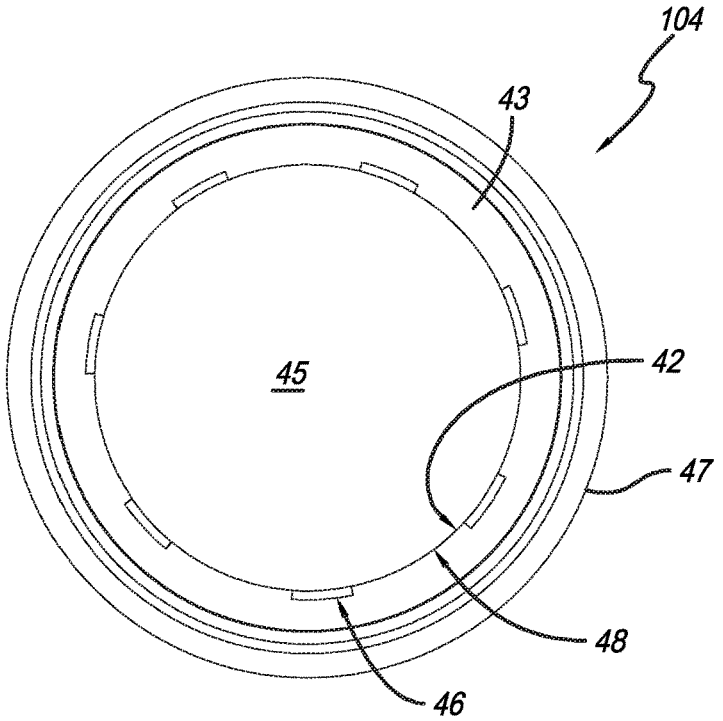
FIG. 16 is a rear elevation view of the barrel of FIG. 13.
Figure 17:
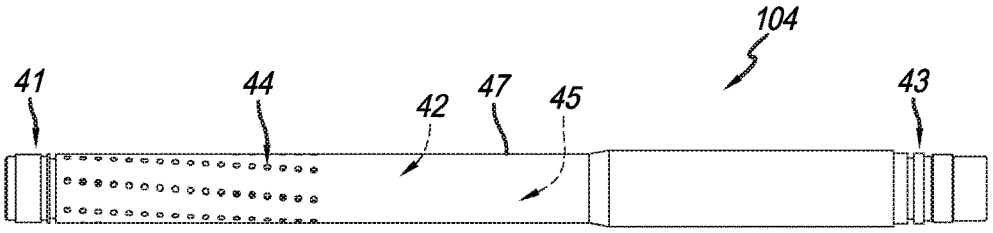
FIG. 17 is a top plan view of the barrel of FIG. 13.
Figure 18:
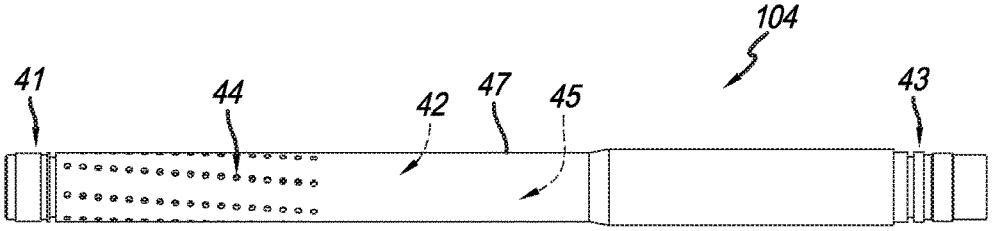
FIG. 18 is a bottom plan view of the barrel of FIG. 13.
Figure 19:
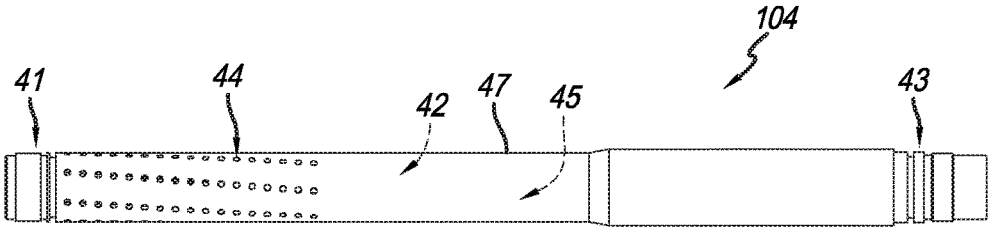
FIG. 19 is a right side elevation view of the barrel of FIG. 13.
Figure 20:
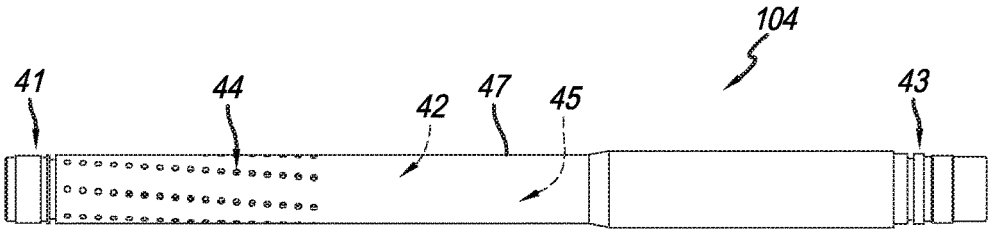
FIG. 20 is a left side elevation view of the barrel of FIG. 13.

One illustrative embodiment of a barrel 104 in accordance with the present disclosure is shown in FIG. 13. Barrel 104 includes a muzzle end 41, a chamber end 43, and a bore 45 extending through barrel 104 form muzzle end 41 to chamber end 43. Rifling 42 is formed in bore 45 and includes grooves 46 and lands 48 as shown in FIGS. 13-16. Rifling 42 is configured to impart spin onto projectiles 103 as projectiles 103 travel through barrel 104. While seven grooves 46 are shown in FIGS. 15 and 16, more or less grooves 46 can be used. In some embodiments, rifling 42 is formed along a substantially entire length of barrel 104 as shown in FIG. 14. In some embodiments, rifling 42 is formed along only part of the length of barrel 104.

A plurality of ports 44 are formed through an exterior surface 47 of barrel 104 and into bore 45 as shown in FIGS. 13 and 14. Ports 44 are formed to align with grooves 46 of rifling 42. In some embodiments, ports 44 are formed along only part of the length of barrel 104 as shown in FIGS. 13-14 and 17-20. In some embodiments, ports 44 are formed along a substantially entire length of barrel 104. In some embodiments, ports 44 are formed into lands 48 alternatively or in addition to grooves 46.

Figure 21:
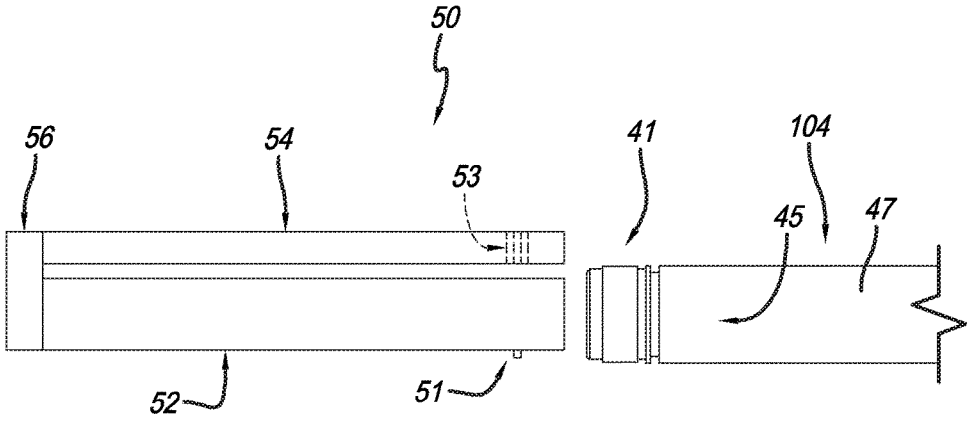
FIG. 21 is a side elevation view of one embodiment of a drill guide in accordance with the present disclosure showing that the drill guide includes a shaft and an alignment arm coupled to an end plate and suggesting that the shaft is sized to be received in a bore of the barrel.
Figure 22:
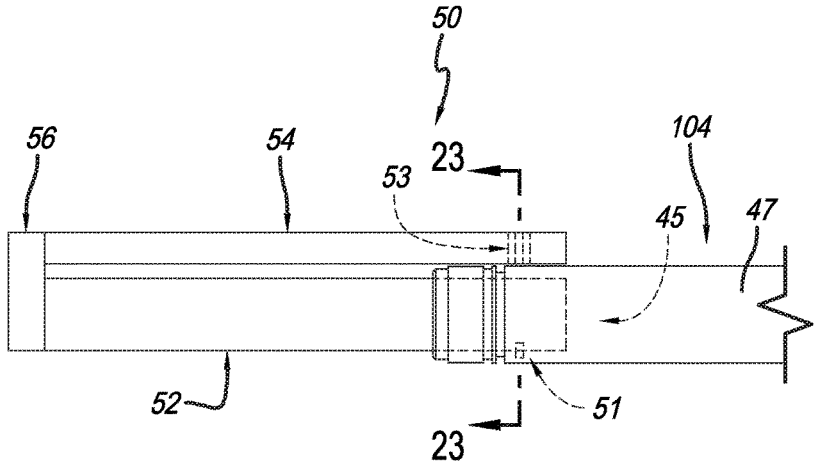
FIG. 22 is a view similar to FIG. 21 showing the shaft extending at least partially into the barrel with the alignment arm extending along an exterior of the barrel.

One illustrative embodiment of a drill guide 50 in accordance with the present disclosure is shown in FIGS. 21 and 22. Drill guide 50 is used to form ports 44 in barrel 104. Drill guide 50 includes a shaft 52 and an alignment arm 54, both coupled to an end plate 56. Shaft 52 is sized to be received in bore 45 of the barrel 104. A guide pin 51 is coupled to shaft 52, and a drill bushing 53 is coupled to alignment arm 54. Shaft 52 extends into bore 45 while alignment arm 54 extends along exterior surface 47 of barrel 104 as suggested in FIG. 22.

Figure 23:
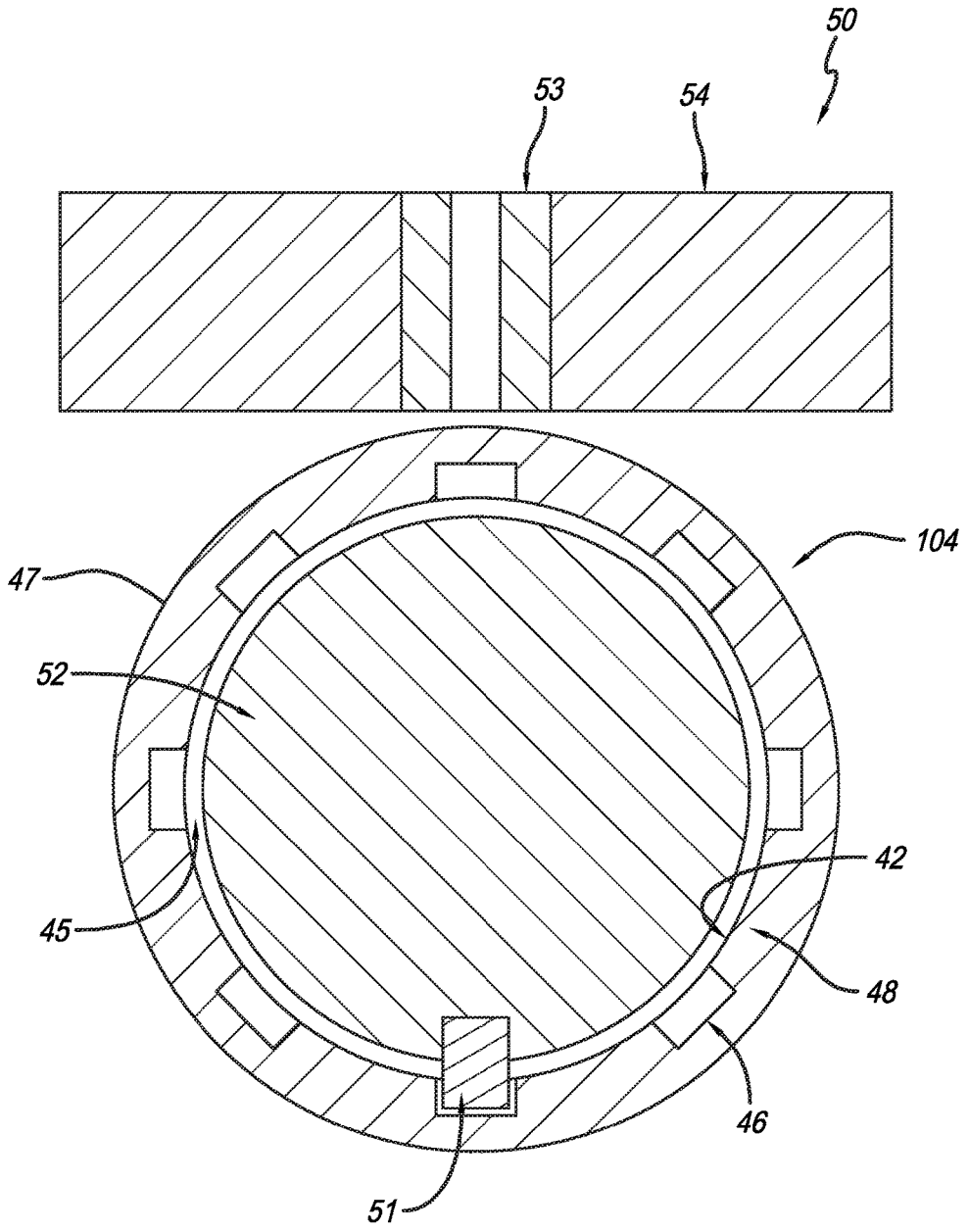
FIG. 23 is a sectional view taken along line 23-23 in FIG. 22 showing that a guide pin coupled to the shaft rides within the grooves of the rifling to align a drill bushing of the alignment arm with another groove of the rifling along an exterior of the barrel.

Rifling 42 is pre-formed into barrel 104, and guide pin 51 rides within grooves 46 to align drill bushing 53 with another groove 46 along exterior surface 47 of barrel 104 as suggested in FIG. 23. Drill bushing 53 is a hardened component configured to guide a drill bit used to form ports 44. In the illustrative embodiment, guide pin 51 and drill bushing 53 are disposed at opposite sides of shaft 52 to correspond with the relative spacing of grooves 46. In some embodiments, guide pin 51 is aligned with drill bushing 53 at the same groove 46. In some embodiments, guide pin 51 and drill bushing 53 are angularly offset from one another.

Figure 24:
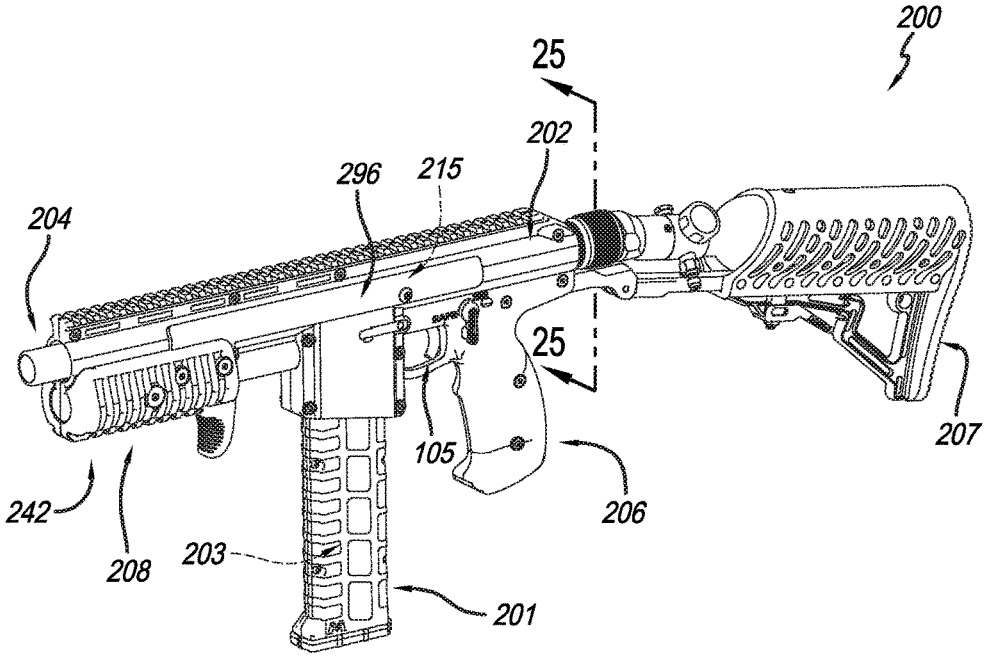
FIG. 24 is a side perspective view of another embodiment of a projectile launcher in accordance with the present disclosure showing that the projectile launcher includes a receiver, a barrel coupled to the receiver, and a tank of compressed gas coupled to the receiver and suggesting that the tank at least partially defines a buttstock of the projectile launcher.

Another embodiment of a projectile launcher 200 in accordance with the present disclosure is shown in FIG. 24. Projectile launcher 200 includes a receiver 202 and a barrel 204 coupled to receiver 202. Projectile launcher 200 is similar to projectile launcher 100 with one difference being that a tank mount 60 is coupled to receiver 202 for attachment of a tank 209 of compressed gas for use in projectile launcher 202. Receiver 202 is configured to accept a magazine 201 containing projectiles 203. In some embodiments, an internal or permanent magazine is used. A rear grip 206 and buttstock 207 are coupled to receiver 202 to maximize mobility and accuracy of projectile launcher 200. In the illustrative embodiment, tank 209 forms at least a portion of buttstock 207.

Figure 40:
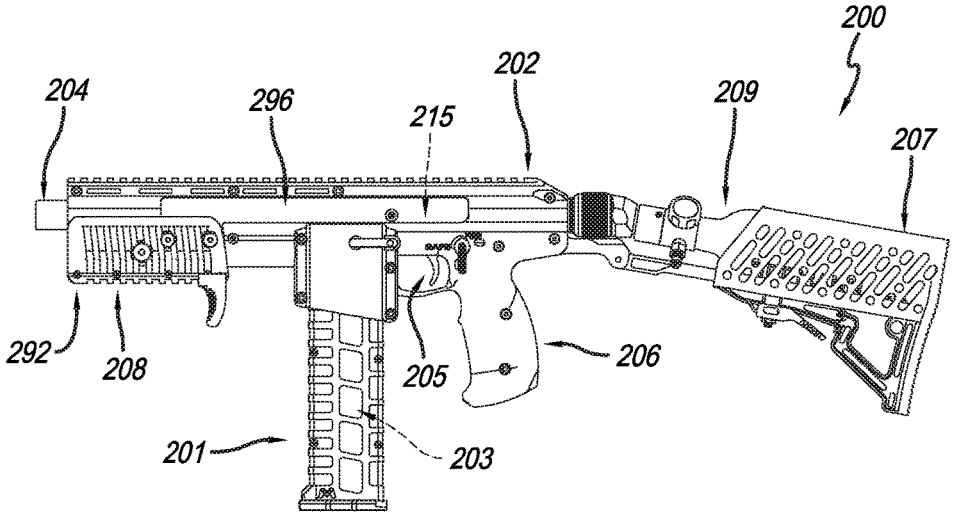
FIG. 40 is a left side elevation view of the projectile launcher of FIG. 24 showing that a left-side connecting arm is coupled to the fore-end grip used to move the bolt.

A charging handle 208 is coupled to receiver 202 for loading projectiles 203 into barrel 204 after each shot as suggested in FIG. 24. In some embodiments, an automatic loading mechanism is used. Projectiles 203 are launched from barrel 204 using compressed gas from tank 209. Charging handle 208 includes a fore-end grip 292 and a left-side connecting arm 296 as shown in FIGS. 24 and 40. Left-side connecting arm 296 is coupled to fore-end grip 292 and a bolt 215. Bolt 215 moves inside receiver 202 to drive projectiles 203 into barrel 204 for launching. Compressed gas is supplied to bolt 215 to force projectile 203 out of barrel 204 after an operator of projectile launcher 200 pulls a trigger 205.

Figure 25:
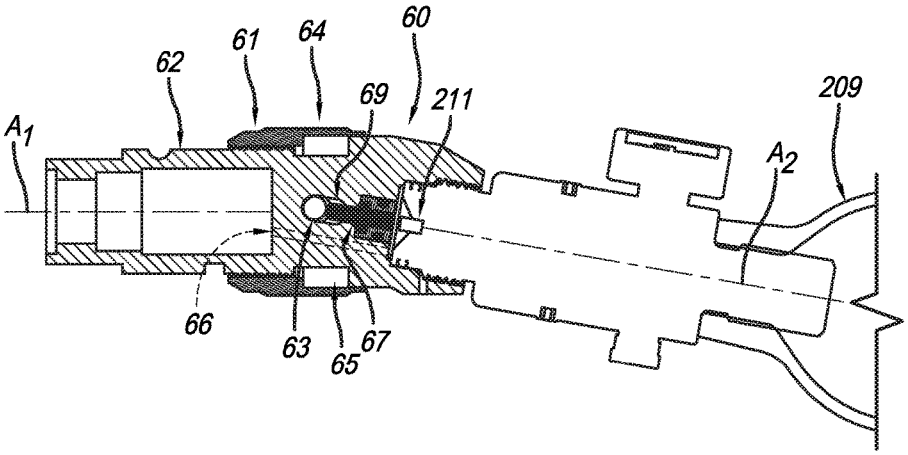
FIG. 25 is a sectional view taken along line 25-25 in FIG. 24 showing the a tank mount in accordance with the present disclosure includes a mount block and a valve actuator coupled the mount block and suggesting that the valve actuator is in a retracted position such that a push pin of the valve actuator is spaced apart from a valve stem of the tank.
Figure 26:
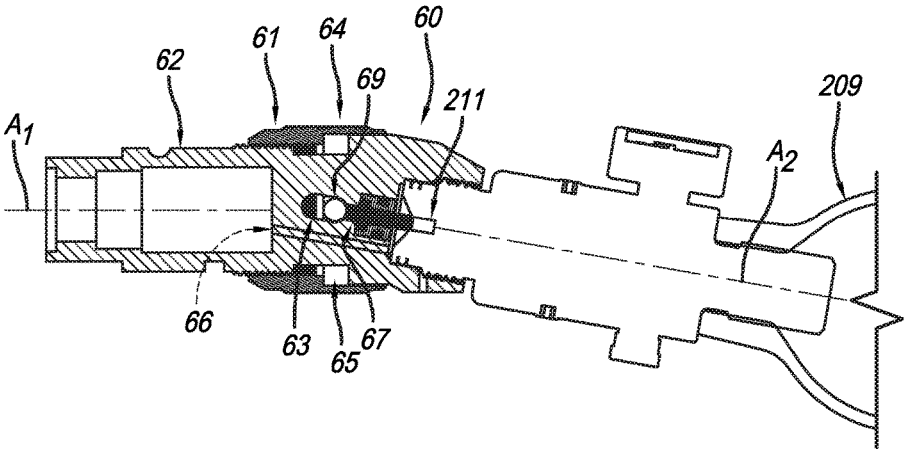
FIG. 26 is a view similar to FIG. 25 showing the valve actuator in an extended position such that the push pin is engaged with the valve stem of the tank to open a valve of the tank and allow compressed gas to flow through a gas passage in the mount block for use in the projectile launcher.

Tank mount 60 includes a mount block 62 and a valve actuator 64 coupled to mount block 62 as shown in FIGS. 25 and 26. Mount block 62 extends along an axis $A_1$ and is configured to accept tank 209 along an axis $A_2$. In the illustrative embodiment, axes $A_1$ and $A_2$ are not parallel and are at an angle with respect to one another. Valve actuator 64 includes a collar 61, a shaft 63, and a push pin 67. Collar 61 is formed to define an internal shoulder 65 configured to engage with shaft 63 to move shaft 63 within a slot 69 of mount block 62. Shaft 63 engages with push pin 67 to move push pin 67 relative to mount block 62.

Push pin 67 is in a retracted position spaced apart from a valve stem 211 of tank 209 as shown in FIG. 25. In the illustrative embodiment, collar 61 is in threaded engagement with mount block 62. Rotating collar 61 relative to mount block 62 forces shoulder 65 against shaft 63 to move shaft 63 and push pin 67 to an extended position as suggested in FIG. 26. In the extended position, push pin 67 engages with valve stem 211 to allow compressed gases to flow from tank 209. A gas passage 66 is formed through mount block 62 to allow the compressed gases to pass through mount block 62 into receiver 202 for use in projectile launcher 200. Opposite rotation of collar 61 allows push pin 67 to move to the retracted position and stop the flow of compressed gases form tank 209.

Figure 27:
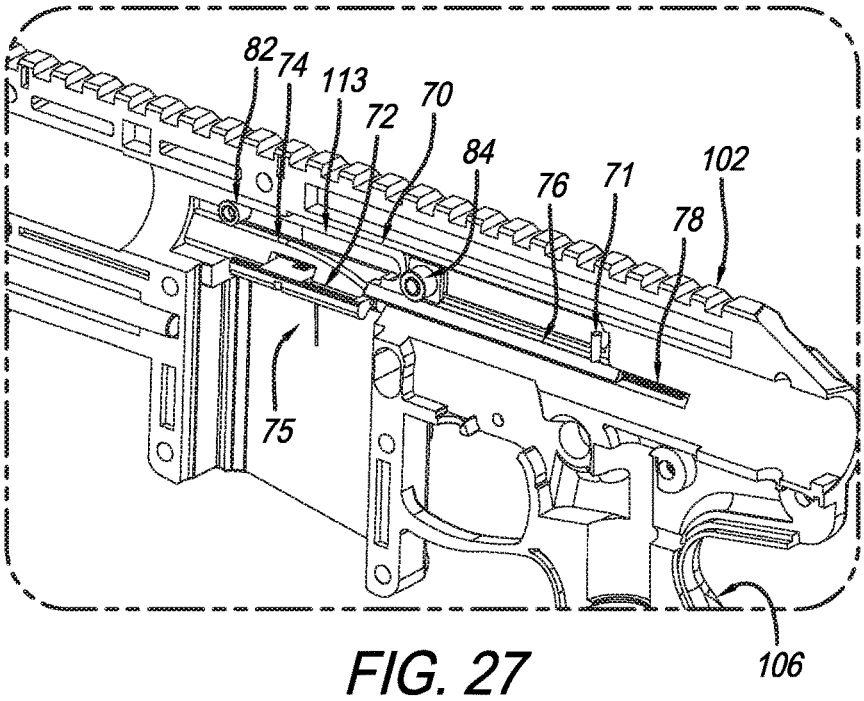
FIG. 27 is an enlarged view of FIG. 24 showing the receiver with portions broken away and that a projectile feeder includes a blocker plate coupled to the receiver, a ramp plate coupled to the blocker plate, and a lock bar positioned in the receiver.
Figure 28:
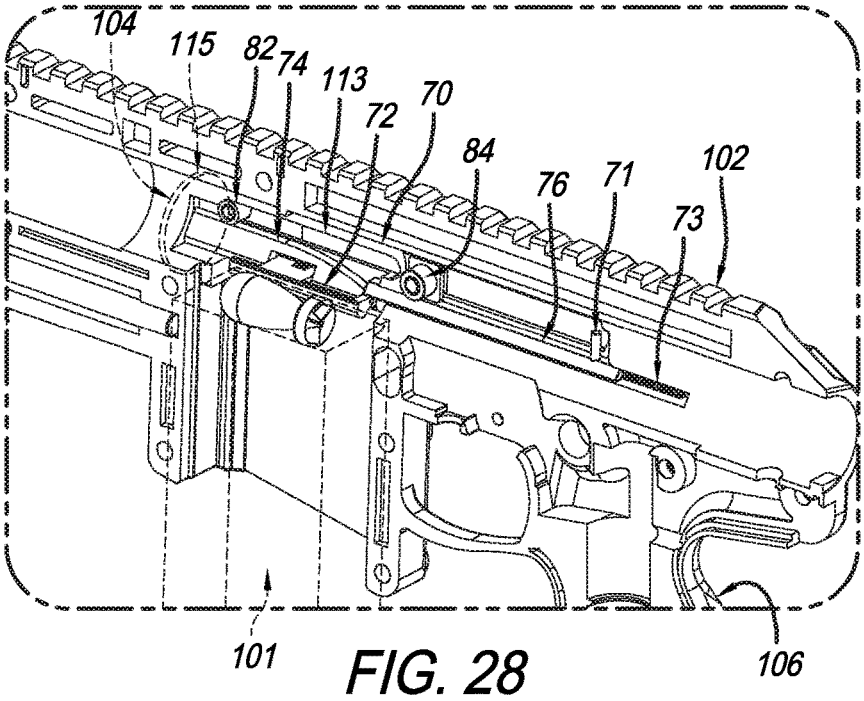
FIG. 28 is a view similar to FIG. 27 showing the blocker plate in a locked position and a projectile, fed from a magazine (shown partially in phantom), engaged with the blocker plate and suggesting that the blocker plate blocks entry of the projectile into the breech when in the locked position.
Figure 31:
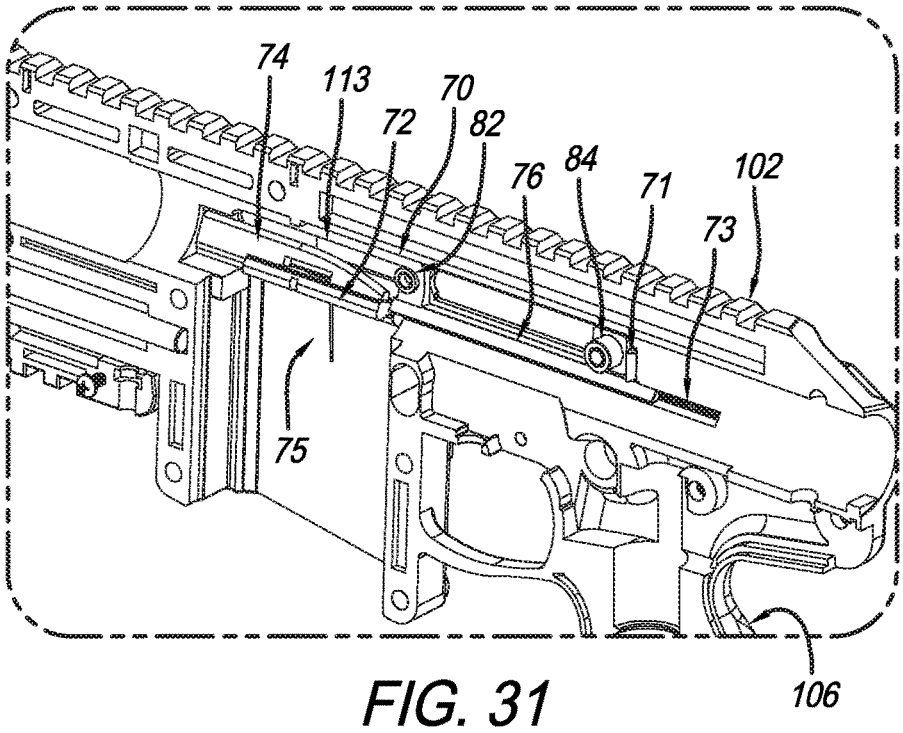
FIG. 31 is a view similar to FIG. 29 showing the blocker plate in the unlocked position.

One embodiment of a projectile feeder 70 in accordance with the present disclosure is shown in FIG. 27. Projectile feeder 70 is configured to control movement of projectiles 103 into a breech 113 of receiver 102. Projectile feeder 70 includes a blocker plate 72 coupled to receiver 102, a ramp plate 74 coupled to blocker plate 72, and a lock bar 76 positioned in receiver 102. Blocker plate 72 is shown in a locked position in FIG. 27 where lock bar 76 is engaged with blocker plate 72 to resist movement of blocker plate 72 from the locked position to an unlocked position, as shown in FIG. 31. A spring 73 biases lock bar toward blocker plate 72. A spring 75 biases blocker plate 72 toward the unlocked position. Projectile 103, fed from magazine 101, engages with blocker plate 72 which blocks entry of projectile 103 into breech 113 when blocker plate 72 is in the locked position as suggested in FIG. 28.

Figure 30:
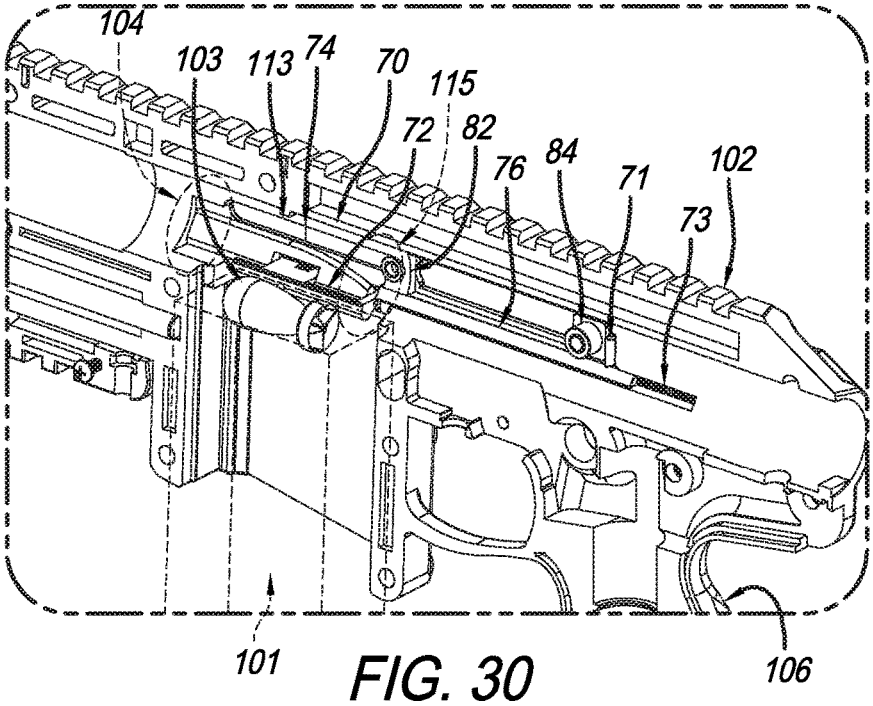
FIG. 30 is a view similar to FIG. 29 showing the projectile engaged with the blocker plate prior to pivoting of the blocker plate.
Figure 39:
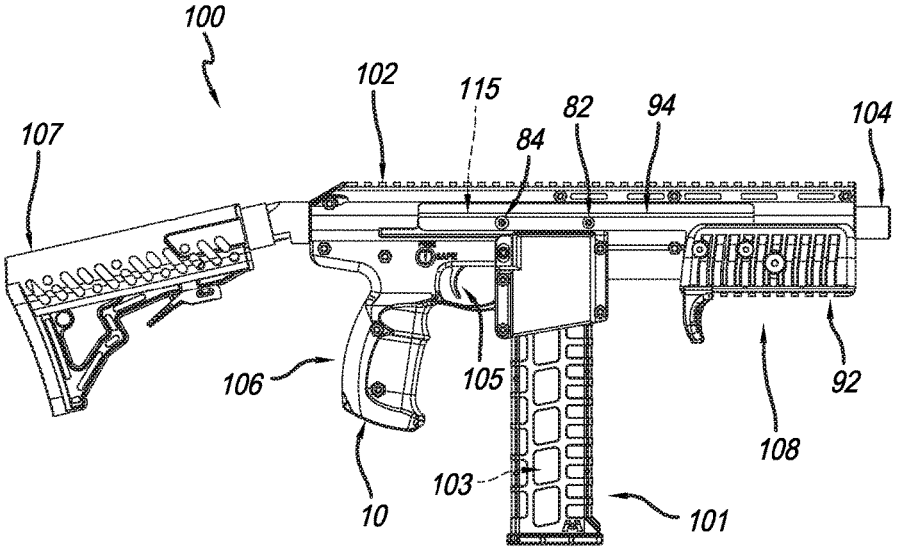
FIG. 39 is a right side elevation view of the projectile launcher of FIG. 1 showing that the charging handle includes a fore-end grip and a right-side connecting arm coupled to the fore-end grip used to move the roller and bar pusher.

A roller 82 and a bar pusher 84 are coupled to a right-side connecting arm 94 of charging handle 108 as shown in FIG. 39. Roller 82 and bar pusher 84, along with bolt 115, move with charging handle 108. Bolt 115 is positioned adjacent to barrel 104, as suggested in FIG. 28, when charging handle 108 is in a charged position, as shown in FIG. 39. Bolt 115 is spaced apart from barrel 104, and opens breech 113 to receive 103, when charging handle 108 is moved to a release position as suggested in FIG. 30.

Figure 29:
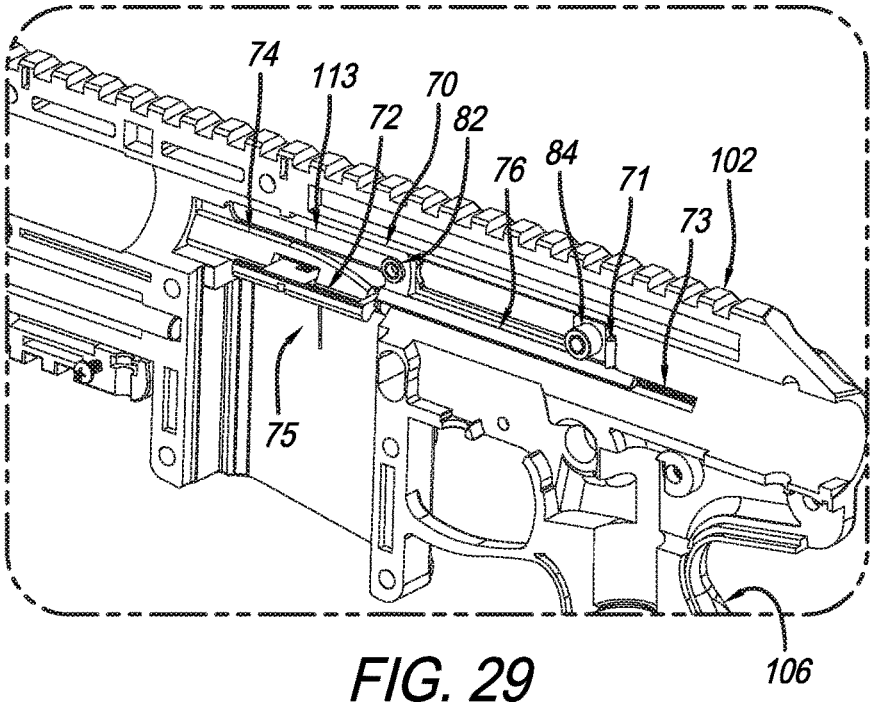
FIG. 29 is a view similar to FIG. 27 showing the lock bar spaced apart from the blocker plate after moving a charging handle to a release position to allow the blocker plate to pivot relative to the receiver to an unlocked position, as shown in FIG. 31, and suggesting that a bar pusher of the charging handle engages with the lock bar to move the lock bar after the charging handle has substantially completed movement to the release position.

Bar pusher 84 engages with a pin 71 to move lock bar 76 relative to blocker plate 72 after moving charging handle 108 to the release position as suggested in FIG. 29. Lock bar 76 is spaced apart from blocker plate 72 to allow blocker plate 72 to pivot relative to receiver 102 to the unlocked position when charging handle 108 has substantially completed movement to the release position. Maintaining blocker plate 72 in the locked position until this point minimizes false-loading and wedging of projectiles 103 in breech 113.

Figure 32:
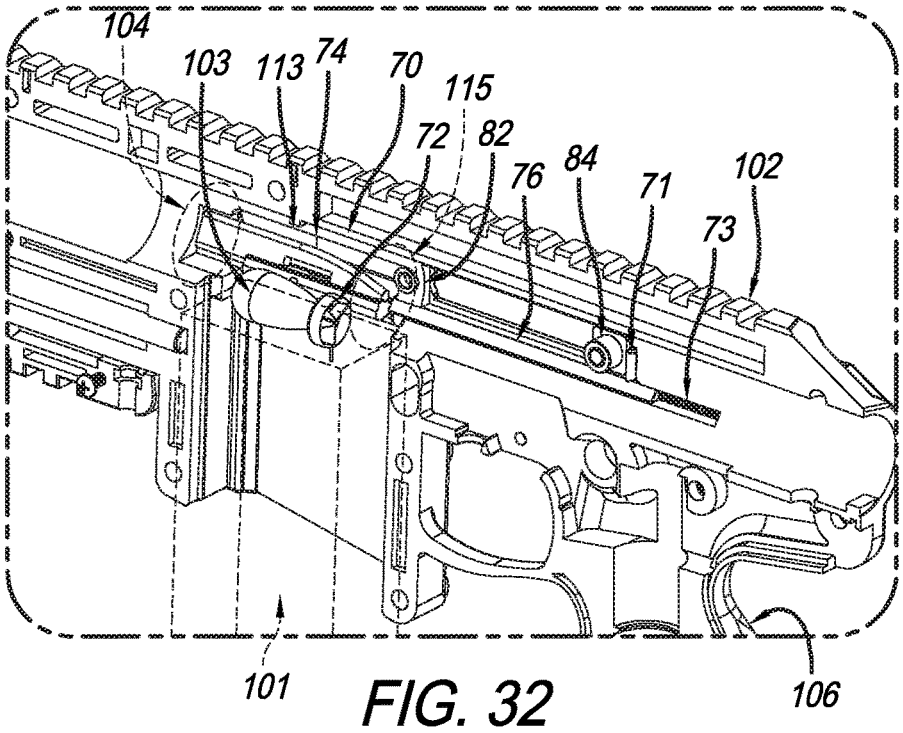
FIG. 32 is a view similar to FIG. 31 showing the projectile at least partially positioned in the breech of the receiver.
Figure 33:
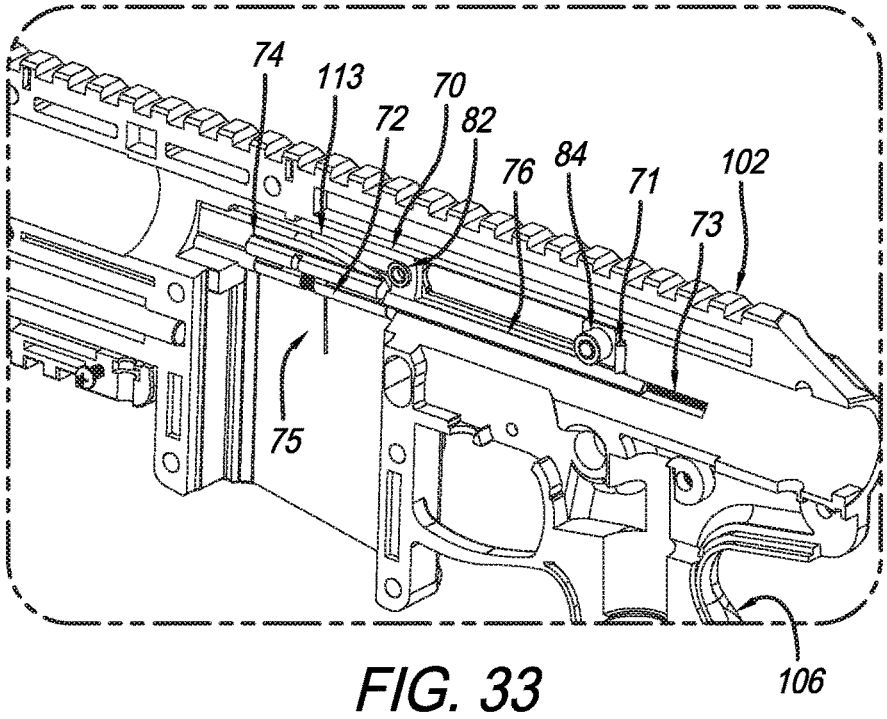
FIG. 33 is a view similar to FIG. 31 showing the blocker plate moved to a pass-through position from the unlocked position.
Figure 34:
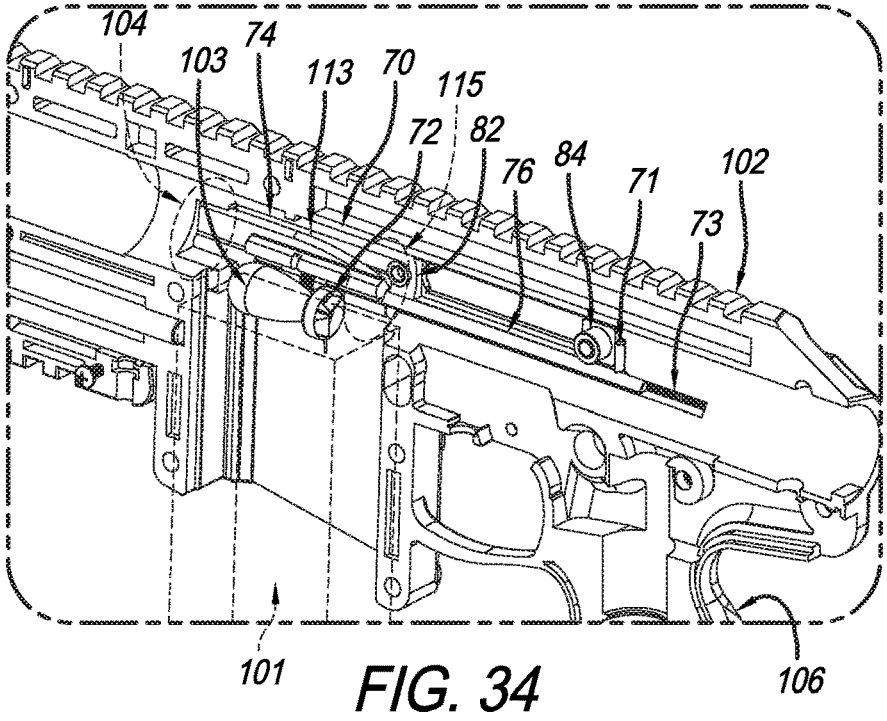
FIG. 34 is a view similar to FIG. 33 showing the projectile prior to entry into the breech and suggesting that the projectile engages with the blocker plate to move the blocker plate to the pass-through position as the projectile is biased toward the breech by the magazine.
Figure 35:
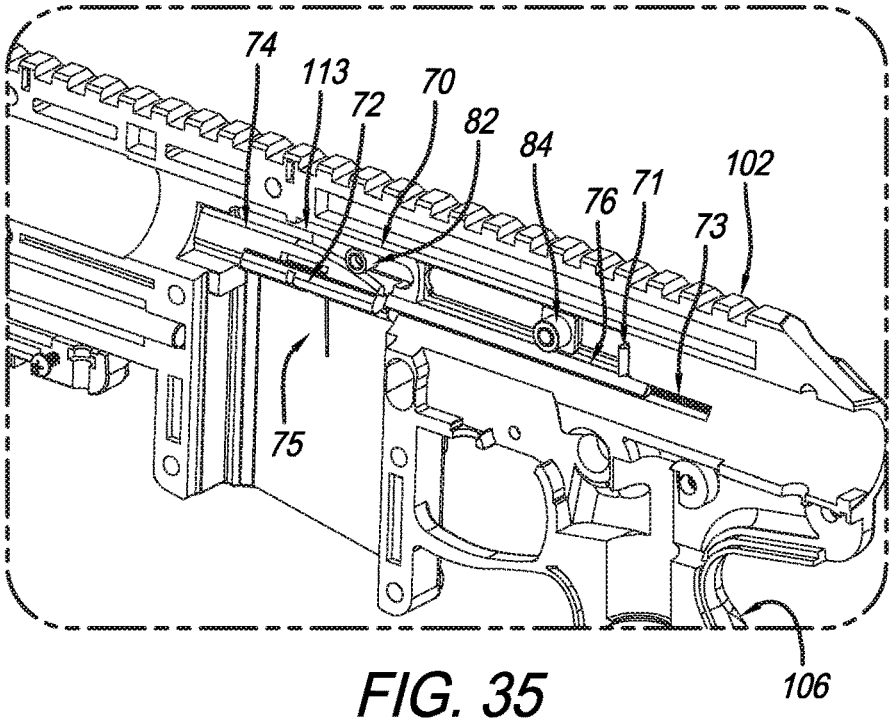
FIG. 35 is a view similar to FIG. 33 showing the blocker plate moved to the unlocked position and suggesting that charging lever is at least partially moved from the release position to a charged position as shown in FIG. 37.
Figure 36:
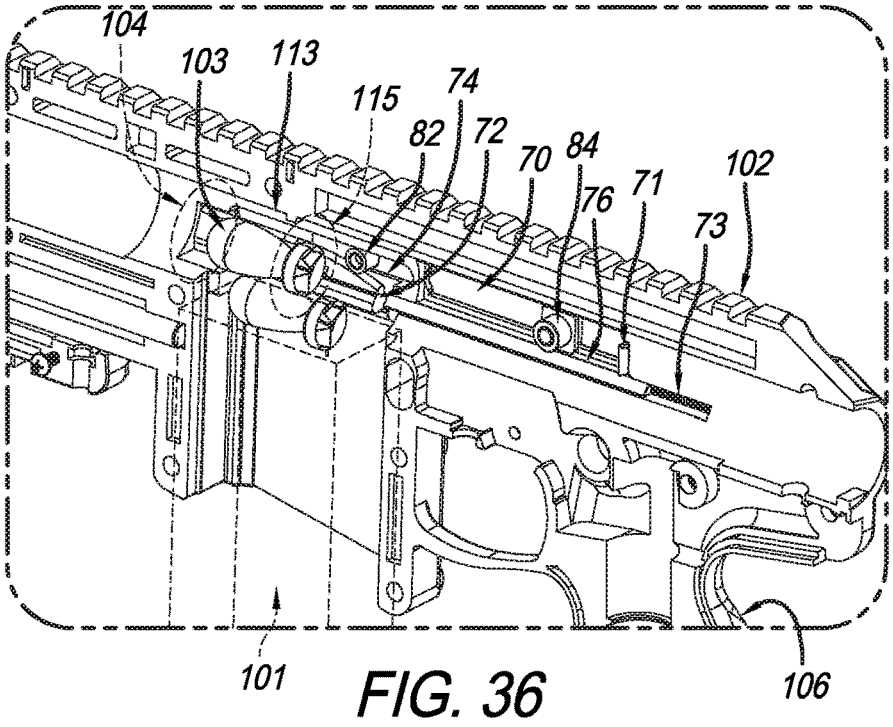
FIG. 36 is a view similar to FIG. 35 showing the projectile moved at least partially toward the barrel (shown partially in phantom) and suggesting that the projectile is biased toward the barrel by a bolt (shown partially in phantom) as the charging handle moves toward the charged position.

Projectile 103 at least partially enters breech 113 of the receiver 102 when blocker plate 72 is in the unlocked position as suggested in FIG. 32. Blocker plate 72 moves to a pass-through position, shown in FIG. 33, from the unlocked position, shown in FIG. 31, as projectile 103 is biased into breech 113 by magazine 101 as suggested in FIG. 34. Movement of charging handle 108 toward the charged position engages roller 82 with ramp plate 74, as shown in FIG. 35, and forces projectile 103 toward barrel 104 as suggested in FIG. 36. Movement of charging handle 108 toward the charged position also releases lock bar 76 which is biased toward blocker plate 72 by spring 73. Lock bar 76 abuts blocker plate 72, but does not resist movement of blocker plate 72 until blocker plate 72 reaches the unlocked position as suggested in FIG. 37.

Figure 37:
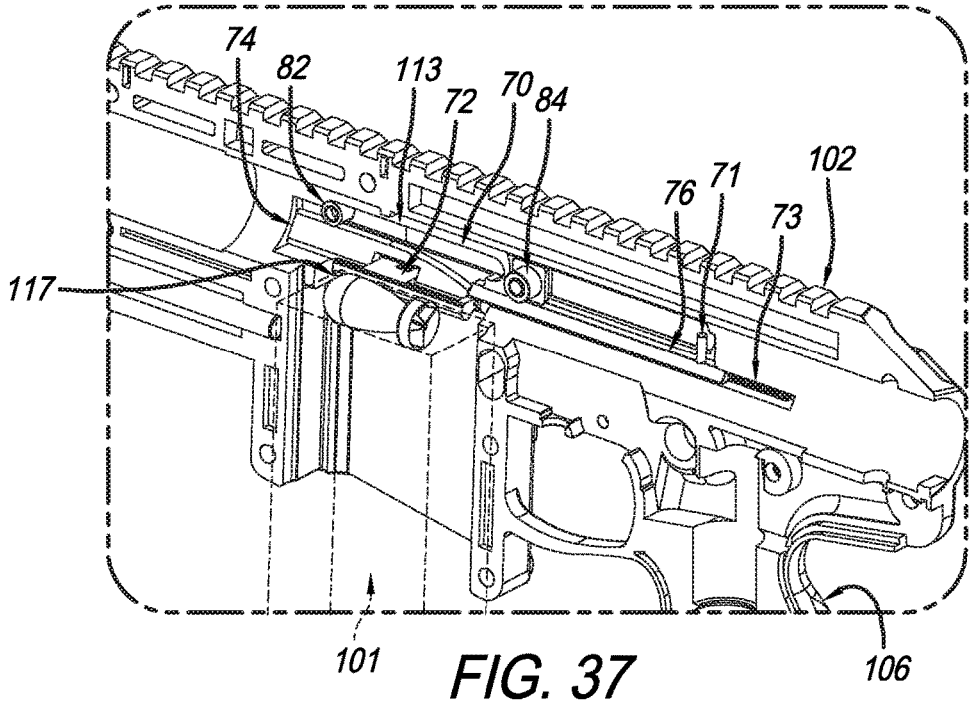
FIG. 37 is a view similar to FIG. 35 showing the blocker plate in the locked position to block entry of a subsequent projectile into the breech and suggesting that a roller of the charging handle engages with the ramp plate to bias the blocker plate toward the locked position as the charging handle moves to the charged position.
Figure 38:
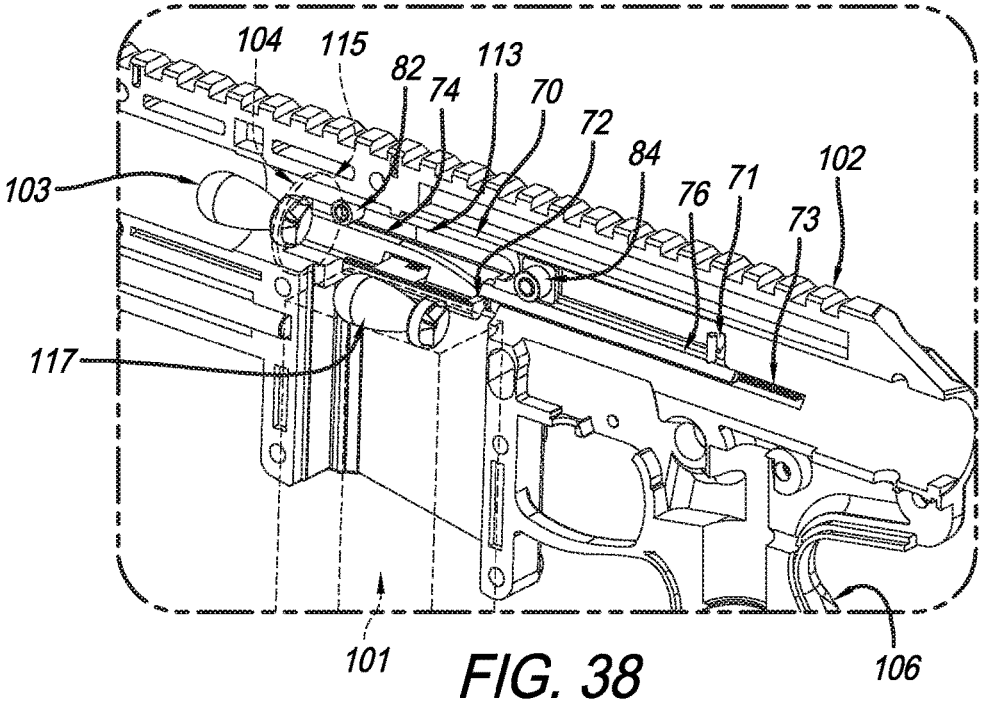
FIG. 38 is a view similar to FIG. 37 showing the projectile received in the barrel when the charging handle is moved to the charged position.

Roller 82 biases blocker plate 72 toward the locked position as charging handle 108 is moved toward the charged position as suggested in FIGS. 35 and 37. Blocker plate 72 blocks entry of a subsequent projectile 117 into breech 113 when blocker plate 72 reaches the locked position. Projectile 103 is received in barrel 104 when charging handle 108 reaches the charged position as shown in FIG. 38.

FIGS. 41-58 show various views of an anti-jam mechanism 300 during a firing sequence according to another embodiment of this disclosure. In the embodiment shown, a first lever 302 cooperates with a second lever 304 to prevent jamming of projectiles in the breech during firing. For example, the second lever 304 selectively restricts movement of the leading projectile 203 in the magazine 201 from entering the breech when the bolt 215 or another projectile 203 is in the breech.

In the embodiment shown, the first lever 302 is pivotally connected to the receiver 202 about pivot pin 306. The first lever 302 has a proximal end 308 and a distal end 310. The proximal end 308 has a curved surface to conform substantially with a projectile 203 and/or bolt 215. The distal end 310 is operatively connected with the second lever 304. As shown, the second lever 304 is pivotally connected to the magazine 201 about a pivot pin 312. The second lever 304 pivots between a first position (FIGS. 42, 46, 52, 54, 56, 58) that blocks movement of the leading projectile 203 in the magazine 201 from being fed into the breech and a second position (FIGS. 48, 50) that allows movement of the leading projectiles in the magazine 201 to be fed into the breech.

Figure 48:
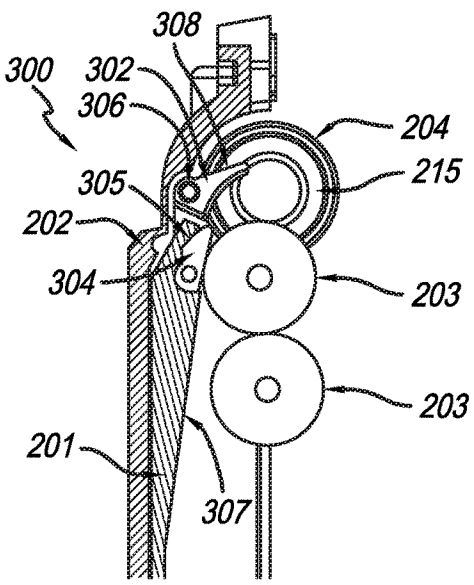
Figure 50:
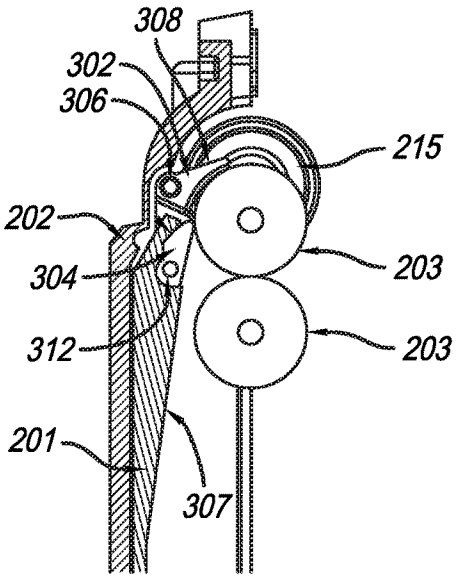

The distal end 310 of the first lever 302 interacts with the second lever 304 during operation. A biasing member urges the second lever 304 to the second position (FIGS. 48, 50). The second lever 304 acts on the distal end 310 of the first lever 302 to pivot the proximal end 308 of the first lever 302 to extend into the breech (FIG. 48) when neither the bolt 215 nor a projectile 203 are in the breech. However, the biasing member has a weaker spring force than the urging of pusher (not shown) in magazine 215 feeding projectiles into the breech; accordingly, a projectile fed into the breech will cause the first lever 302 to pivot away from the breech. This pivoting action of the first lever 302 will move the second lever 304 to the first position (FIGS. 42, 46, 52, 54, 56, 58) due to the distal end 310 of the first lever 302 acting on the second lever 304. Thus, second lever 304 will cycle between the first position (blocking projectiles from entering breech) and the second position (allowing projectiles to be fed into breech) based on whether the bolt 215 or a projectile 203 are in the breech.

Figure 42:
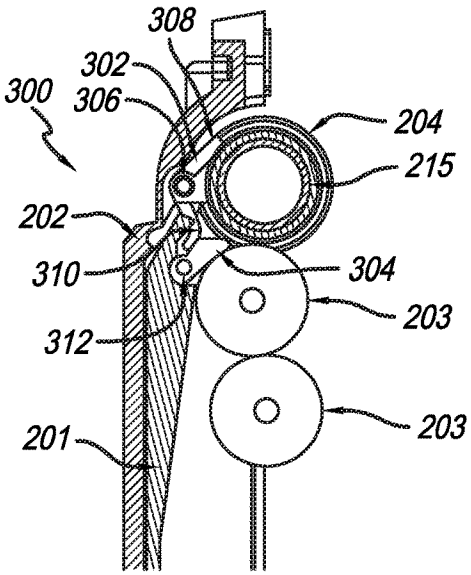
FIGS. 42, 44, 46, 48, 50, 52, 54, 56, and 58 are front cross-sectional views corresponding to the projectile launcher shown in FIGS. 41, 43, 45, 47, 49, 51, 53, 55, and 57.
Figure 41:
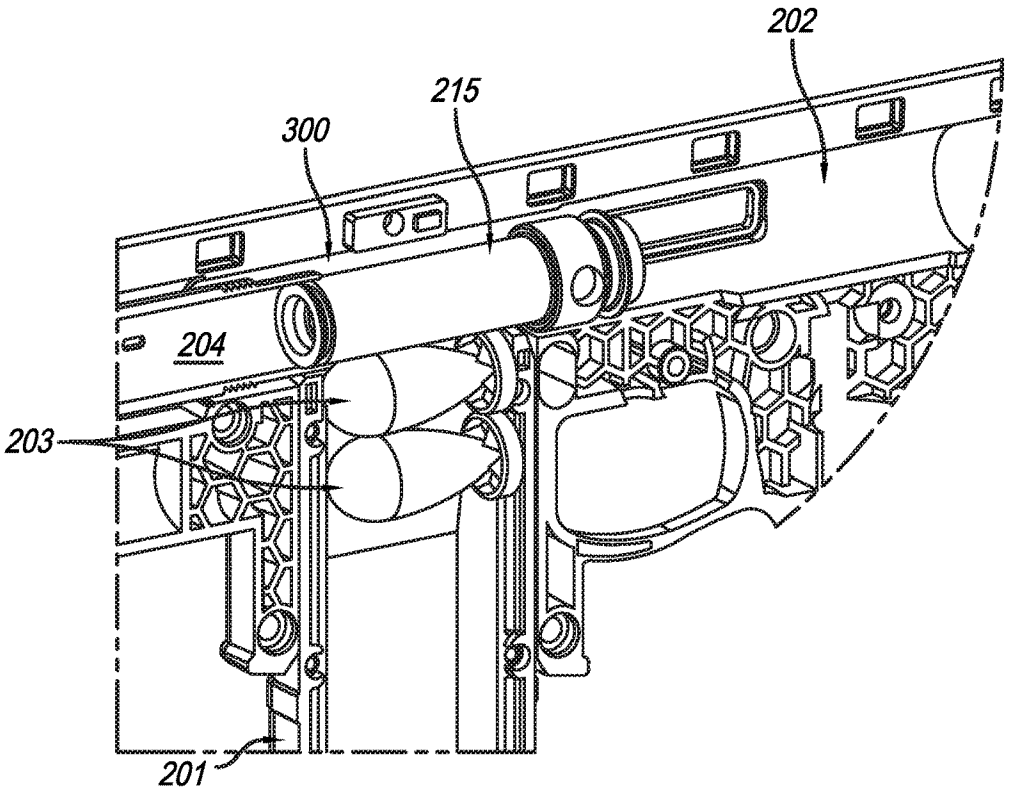
FIGS. 41, 43, 45, 47, 49, 51, 53, 55, and 57 are left side perspective views of the projectile launcher with a portion of the receiver exposed to show internal operation of an anti-jam mechanism according to another embodiment during a firing sequence.

FIGS. 41 and 42 illustrate the anti-jam mechanism 300 prior to the projectile launcher 200 being cocked. In this position, the bolt 215 extends into the breech. For example, this could occur prior to the projectile launcher 200 being cocked using the charging handle 108 or between automatic cocking in a semi-automatic or fully-automatic projectile launcher. In this position, the bolt 215 prevents the proximal end of the first lever 302 from extending into the breech. The distal end 310 of the first lever 302 overcomes urging of biasing member on second lever to the second position and maintains the second lever 304 in the first position blocking the leading projectile 203 in the magazine 201 from entering the breech.

Figure 44:
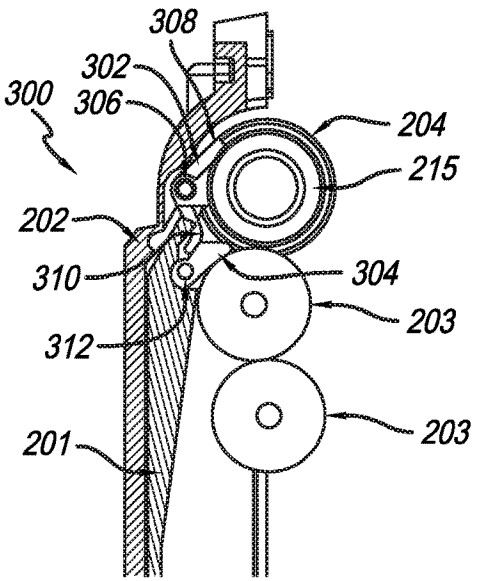
Figure 43:
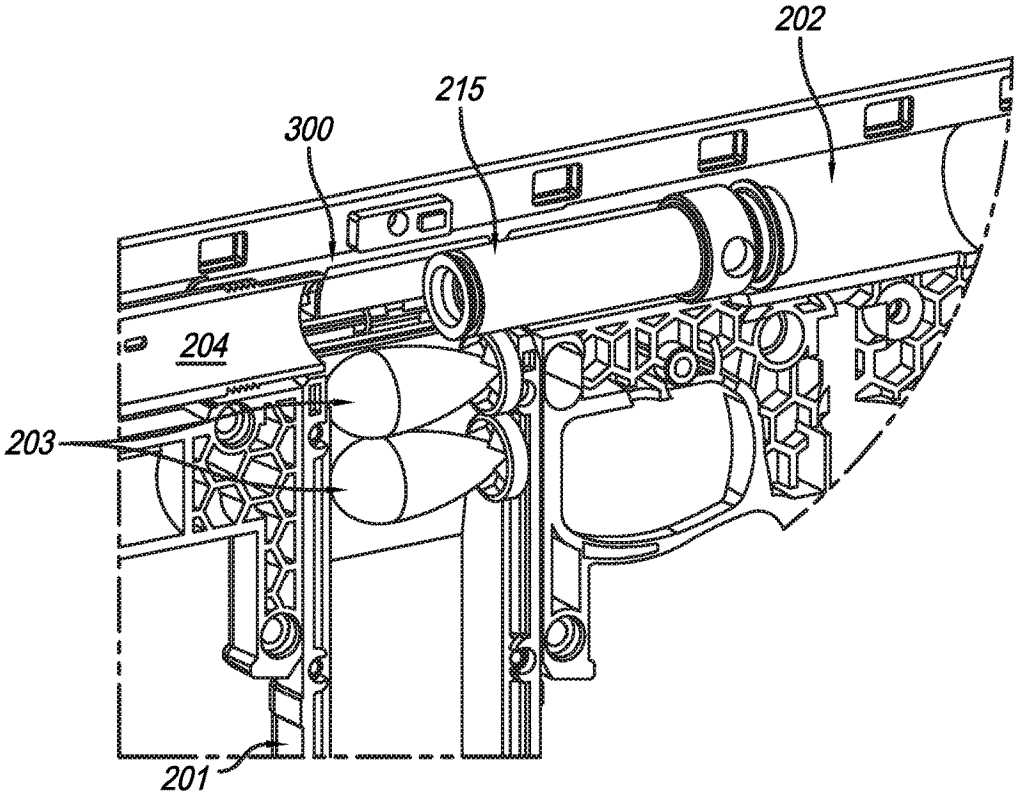
Figure 46:
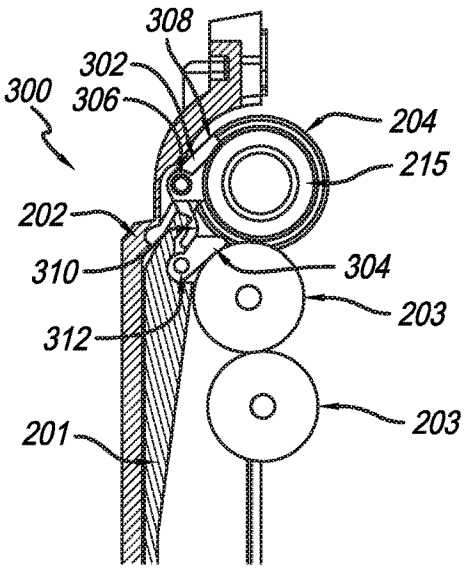
Figure 45:
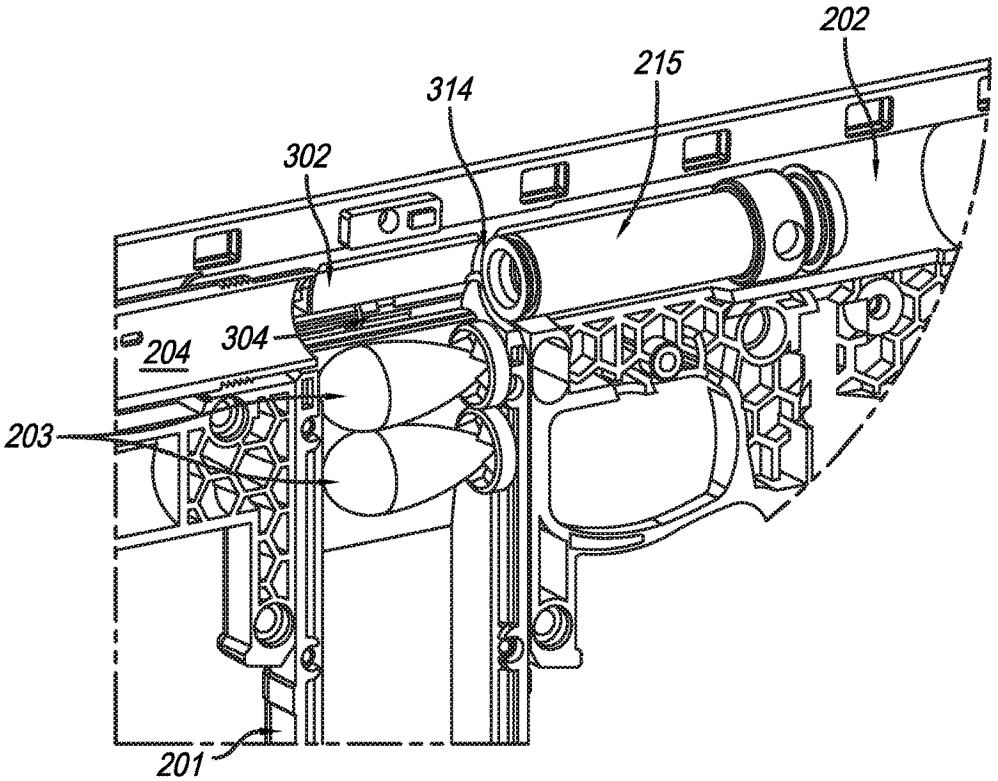

FIGS. 43 and 44 show the bolt 215 moving in direction 316 towards a cocking position. However, the leading end 314 of the bolt 215 has not yet cleared the first lever 302. Accordingly, the second lever 304 is still in the first position blocking the leading projectile 203 from being fed into the breech. FIGS. 45 and 46 show the continued movement of the bolt 215 in direction 316 toward the cocked position immediately upon the leading end 314 of the bolt 214 clearing the first lever 302.

Figure 47:
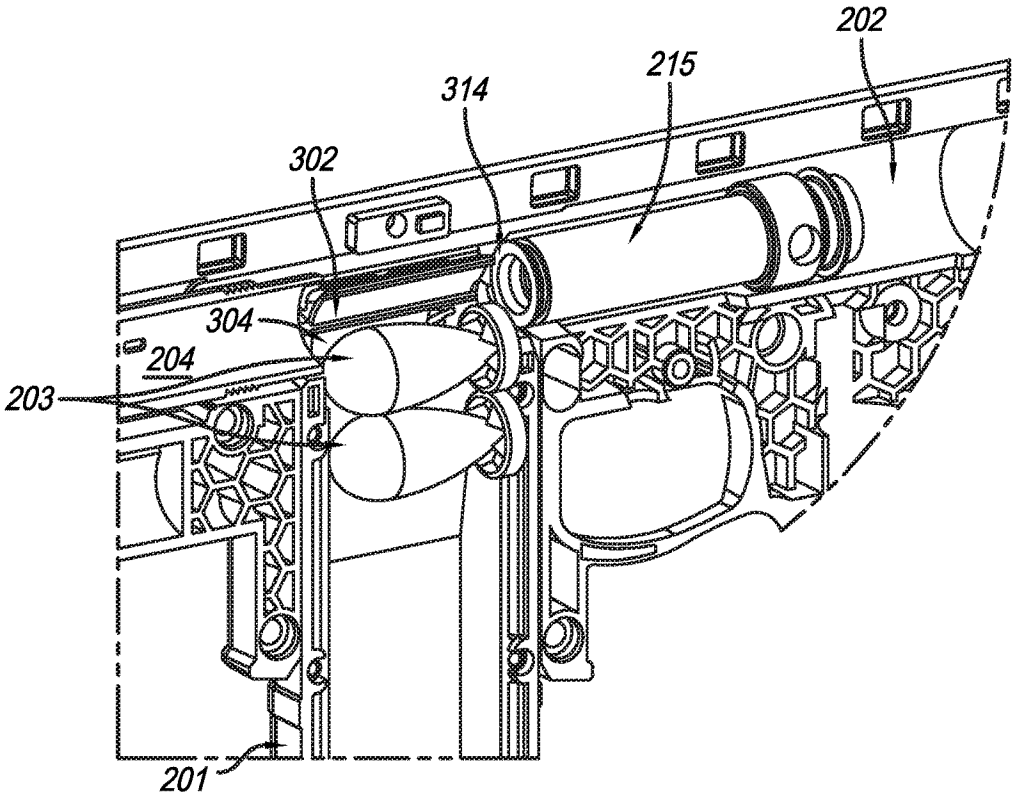

Shortly after the leading end 314 of the bolt 215 clears the first lever 302, the urging of biasing member will pivot the second lever 304 towards the second position that allows the leading projectile 203 to enter the breech from the magazine 201 as shown in FIGS. 47-48. As shown, the magazine 201 includes a recessed area 305 that is dimensioned to receive the second lever 302. In this position, the second lever 302 is substantially flush with the inner wall 307 of the magazine 201.

Figure 49:
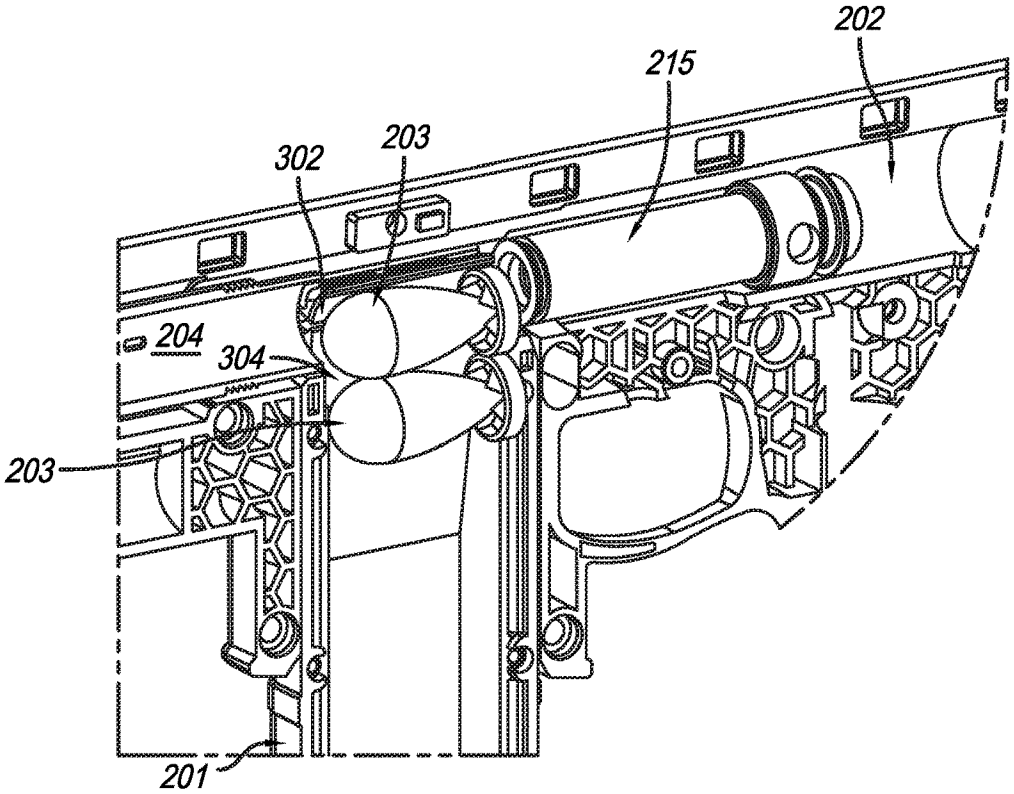
Figure 52:
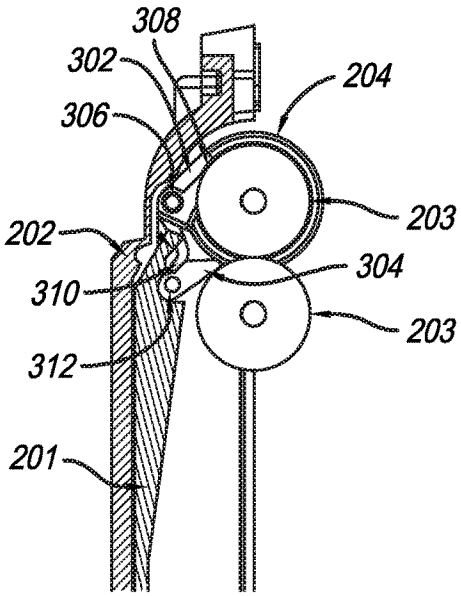
Figure 51:
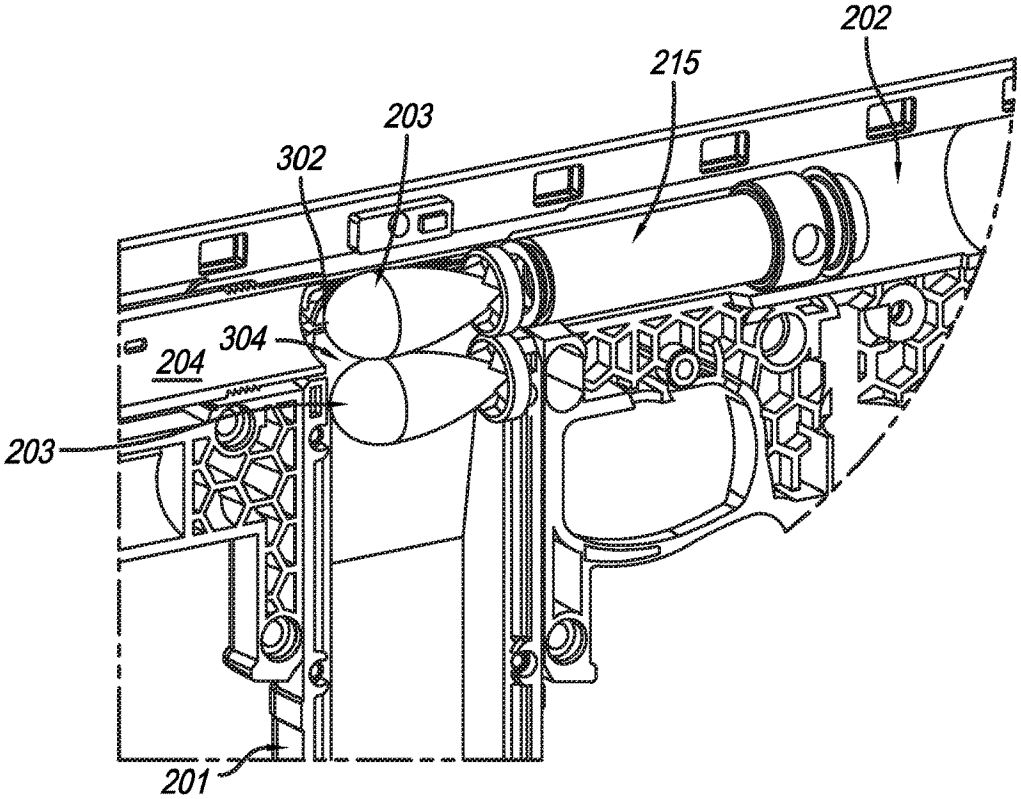

The movement of the second lever 304 acts on distal end of 310 of first lever to pivot the first lever 302 about the pivot pin 306 so the proximal end 308 will extend into the breech. As shown, the leading projectile will continue to enter breech due to urging of pusher (not shown) in magazine 201. FIGS. 49-50 show the leading projectile 203 starting to engage the proximal end 308 of the first lever 302. As the leading projectile 203 continues to move into the breech, this force on the proximal end 308 will pivot the first lever (counter-clockwise as shown), which moves the second lever 304 back to the first position that blocks further projectiles from entering the breech as shown in FIGS. 51 and 52.

Figure 54:
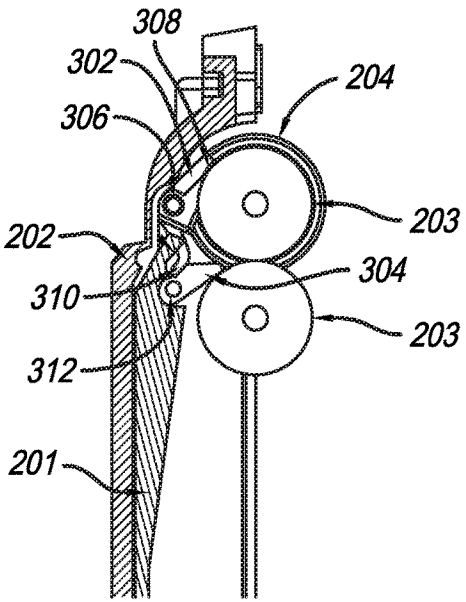
Figure 53:
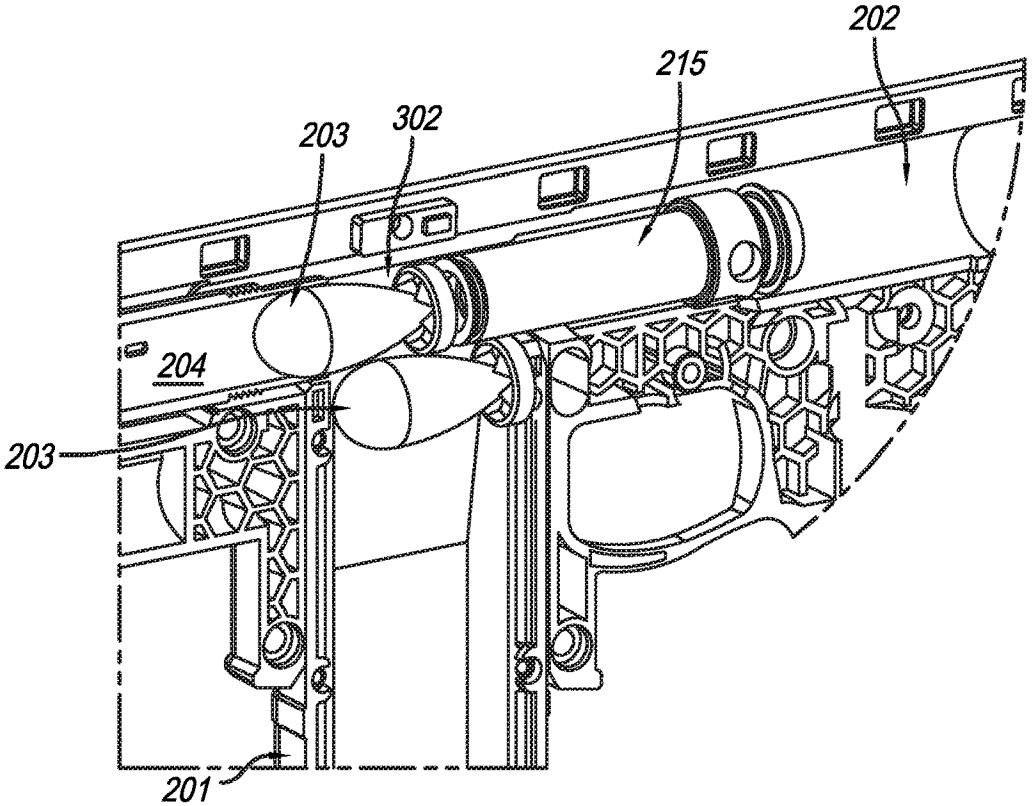
Figure 56:
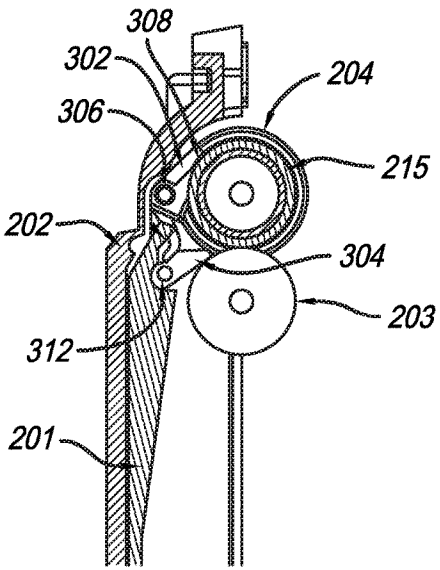
Figure 55:
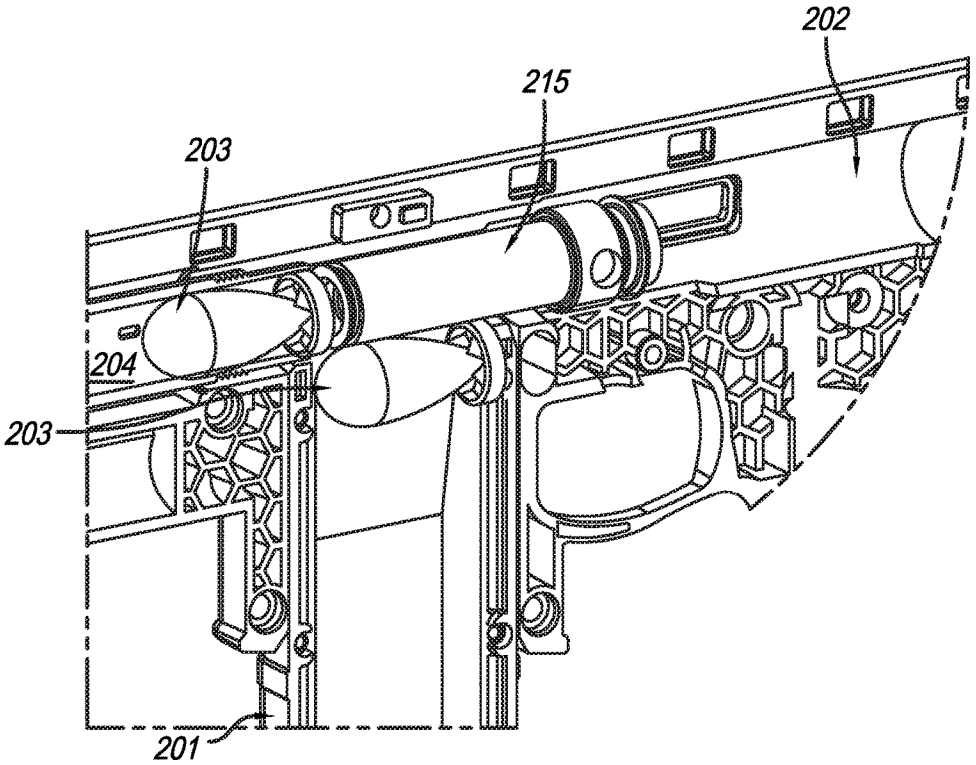

FIGS. 53 and 54 show the anti-jam mechanism shortly after actuating the firing mechanism, which drives the bolt in direction 318 towards the barrel 204. In this position, a projectile 203 and the leading end 314 of the bolt are in the breech, which maintains the second lever in the first position blocking any further projectiles from entering the breech until the firing cycle is complete. FIGS. 55 and 56 show the bolt 215 continuing in direction 318 and pushing the projectile further into the barrel 204. As shown, the second lever 304 is still in the first position blocking any further projectiles from entering the breech.

Figure 58:
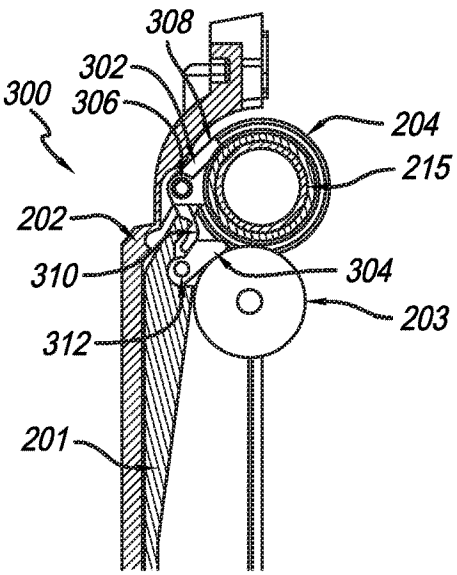
Figure 57:
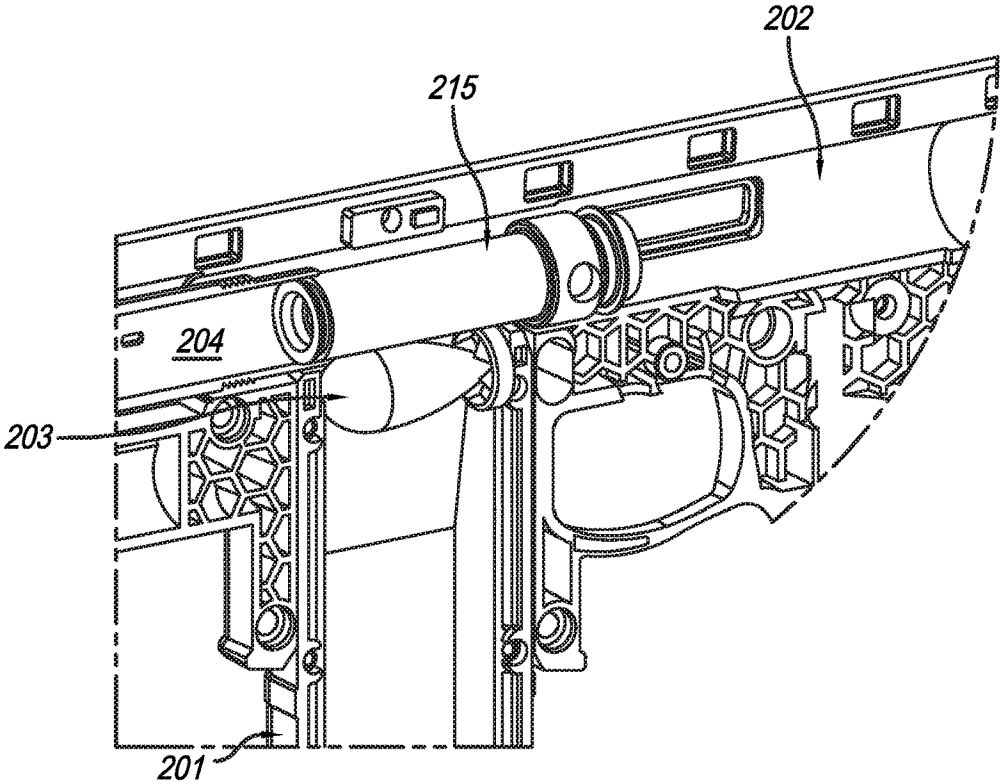

FIGS. 57 and 58 show the anti-jam mechanism after firing the projectile. In this example, the bolt 215 remains in the breech, which maintains the second lever 304 in the first position blocking the next projectile 203 from entering the breech. The cycle continues when the bolt 215 is moves towards a cocking position.

The above descriptions related to projectile launcher 100 are equally applicable to projectile launcher 200. The above descriptions related to projectile launcher 200 are equally applicable to projectile launcher 100. In some embodiments, projectiles are automatically loaded from the magazine into the barrel such as with the use of springs and gas pressure. In some embodiments, the projectile launchers are configured for semi-automatic fire. In some embodiments, the projectile launchers are configured for fully-automatic fire.

EXAMPLES

Illustrative examples of the projectile launcher disclosed herein are provided below. An embodiment of the projectile launcher may include any one or more, and any combination of, the examples described below.

Example 1 is a projectile launcher with a barrel defining a longitudinal bore dimensioned to receive a projectile. The launcher includes a receiver including a breech proximate the barrel, wherein the receiver includes a grip portion defining an opening dimensioned to receive a compressed gas cartridge, wherein the receiver includes a gas transfer mechanism configured to pierce a seal of the compressed gas cartridge disposed in the opening. A valve assembly is included that is configured to be in fluid communication with the gas transfer mechanism, wherein the valve assembly is configured to selectively vent a source of compressed gas into the breech to propel a projectile out of the barrel. The launcher includes a firing assembly configured to actuate the valve assembly responsive to a trigger pull. In some embodiments, the launcher includes a selector assembly operatively connected with the grip portion, wherein the selector assembly includes a door movable between an open position that allows the compressed gas cartridge to be removed from the opening, a closed position that retains the compressed gas cartridge in the opening, and an activation position where the door cooperates with the gas transfer mechanism to pierce the seal in the compressed gas cartridge.

In Example 2, the subject matter of Example 1 is further configured wherein the door comprises a proximal end pivotally connected to the grip portion and a distal end extending from the proximal end.

In Example 3, the subject matter of Example 2 is further configured wherein in distal end of the door moves further into the opening in the grip portion when in the activation position.

In Example 4, the subject matter of Example 3 is further configured wherein the distal end of the door includes a magnetically attracted material and the selector assembly includes a magnet to retain the door in the closed position.

In Example 5, the subject matter of Example 4 is further configured wherein the magnet is spring-loaded to urge the distal end of the door from the activation position to the closed position.

In Example 6, the subject matter of Example 5 is further configured wherein a force applied to the distal end of the door overcomes the spring-loaded magnet such that the door moves the compressed gas cartridge towards the gas transfer mechanism to pierce the seal.

In Example 7, the subject matter of Example 6 is further configured wherein the selector assembly is configured to latch the door in the closed position with a force less than a sufficient force to move the spring-loaded magnet due to the magnetic coupling between the magnet and the door.

In Example 8, the subject matter of Example 7 is further configured wherein the door includes a low friction surface configured to engage the compressed gas cartridge when the door moves from the closed position to the activation position.

In Example 9, the subject matter of Example 8 is further configured wherein the low friction surface is a roller.

In Example 10, the subject matter of Example 1 is further configured wherein the door is movable to a venting position where the door retains the compressed gas cartridge in the opening, but spaced apart from the gas transfer mechanism to vent any residual gas in the cartridge out of the opening.

In Example 11, the subject matter of Example 10 is further configured wherein the door is configured to pivot away from the gas transfer mechanism when moving between the closed position to the venting position.

In Example 12, the subject matter of Example 11 is further configured wherein the door is configured to be biased away from the open position to the venting position to prevent residual gas in the cartridge from driving the cartridge out of the opening in the grip.

Example 13 is a projectile launcher comprising a barrel defining a longitudinal bore dimensioned to receive a projectile. The launcher includes a receiver including a breech proximate the barrel, wherein the receiver includes an opening dimensioned to receive a compressed gas cartridge, wherein the receiver includes a gas transfer mechanism configured to pierce a seal of the compressed gas cartridge disposed in the opening. A valve assembly is included that is configured to be in fluid communication with the gas transfer mechanism, wherein the valve assembly is configured to selectively vent a source of compressed gas into the breech to propel a projectile out of the barrel. The launcher includes a firing assembly configured to actuate the valve assembly responsive to a trigger pull. In some embodiments, the launcher includes a selector assembly including a door movable between an open position, a closed position and an activation position for selectively retaining the compressed gas cartridge in the opening, wherein the selector assembly includes means for retaining the compressed gas cartridge in the opening without piercing the seal when a force applied to the door is less than a predetermined force in the closed position and to pierce the seal when a force greater than the predetermined force is applied to the door in the closed position.

In Example 14, the subject matter of Example 13 is further configured wherein the door is pivotally connected to the receiver.

In Example 15, the subject matter of Example 14 is further configured wherein the selector assembly is configured to retain the door in the closed position with at least one magnet.

In Example 16, the subject matter of Example 15 is further configured wherein the at least one magnet is spring-loaded, and the predetermined force overcomes the urging on the magnet to allow the door to move to the activation position.

Example 17 is a method of operating a projectile launcher. The method includes the steps of pivoting a door covering an opening in a grip of a projectile launcher to an open position that provides access to the opening; inserting a compressed gas cartridge into the opening in the grip; pivoting the door to a closed position with a first force to retain the compressed gas cartridge in the opening, wherein the first force is insufficient to move the door to an activation position that pierces the compressed gas cartridge; and applying a second force to the door to pivot the door past the closed position to the activation position that pierces the compressed gas cartridge, wherein the second force is greater than the first force.

In Example 18, the subject matter of Example 17 is further configured to include the step of pivoting the door to a venting position in which the door retains the compressed gas cartridge in a position that allows residual gas to be vented.

In Example 19, the subject matter of Example 18 is further configured to include the step of pivoting the door from the venting position and the open position and removing the compressed gas cartridge.

In Example 20, the subject matter of Example 19 is further configured such that the door is retained in the closed position via a magnetic connection.

Example 21 is a projectile launcher including a barrel defining a longitudinal bore dimensioned to receive a projectile. The launcher includes a receiver including a breech proximate the barrel and a valve assembly configured to selectively vent a source of compressed gas into the breech to propel a projectile out of the barrel. A firing assembly is provided that is configured to actuate the valve assembly responsive to a trigger pull. The launcher includes a magazine configured to be coupled with the receiver for feeding projectiles into the breech. In some embodiments, the launcher includes an anti-jam mechanism including at least one lever configured to pivot between a first position that blocks projectiles from entering the breech and a second position that allows a projectile to enter the breech, wherein the lever pivots between the first position and the second position responsive to whether an bolt and/or a projectile is in the breech.

In Example 22, the subject matter of Example 21 is further configured wherein the anti-jam mechanism includes a first lever and a second lever.

In Example 23, the subject matter of Example 22 is further configured such that the first lever is movable between a first position extending into the breech and a second position out of the breech.

In Example 24, the subject matter of Example 23 is further configured wherein the second lever is movable between a first position that blocks projectiles from entering the breech and a second position that allows projectiles to enter the breech.

In Example 25, the subject matter of Example 24 is further configured wherein the first lever and the second lever move between their respective first and second positions by pivoting.

In Example 26, the subject matter of Example 25 is further configured wherein the first lever is pivotally connected to the receiver.

In Example 27, the subject matter of Example 26 is further configured wherein the second lever is pivotally connected to the magazine.

In Example 28, the subject matter of Example 27 is further configured wherein the first lever has a proximal end that extends into the breech in the first position and a distal end that engages with the second lever.

In Example 29, the subject matter of Example 28 is further configured with a biasing member urging the first lever towards the second position.

In Example 30, the subject matter of Example 29 is further configured wherein movement of the first lever from the first position to the second position moves the second lever to the first position.

In Example 31, the subject matter of Example 30 is further configured wherein movement of the second lever from the first position to the second position moves the first lever from the second position to the first position.

In Example 32, the subject matter of Example 31 is further configured wherein the magazine includes a recessed area dimensioned to receive the second lever.

Example 33 is a projectile launcher with a barrel defining a longitudinal bore dimensioned to receive a projectile and a receiver including a breech proximate the barrel. The launcher includes a valve assembly configured to selectively vent a source of compressed gas into the breech to propel a projectile out of the barrel. A firing assembly is provided that is configured to actuate the valve assembly responsive to a trigger pull. In some embodiments, the launcher includes a tank mount configured to be coupled with the receiver to fluidly connect a tank of compressed gas with the valve assembly, wherein the tank mount includes a mount block configured to be coupled with the receiver along a first axis, wherein the mount block is configured to be coupled with a tank of compressed gas along a second axis, wherein the first axis and second axis are not parallel.

In Example 34, the subject matter of Example 33 is further configured wherein the first axis is substantially coaxial with a longitudinal axis of the receiver.

In Example 35, the subject matter of Example 34 is further configured wherein the second axis is substantially coaxial with a longitudinal axis of the tank of compressed gas.

In Example 36, the subject matter of Example 36 is further configured wherein the tank mount includes a valve actuator with a push pin movable between a first position that engages a valve stem in the tank of compressed gas to release compressed gas from the tank and a second position that does not engage the valve stem of the tank.

In Example 37, the subject matter of Example 36 is further configured wherein a longitudinal axis of the push pin is substantially coaxial with the second axis.

In Example 38, the subject matter of Example 37 is further configured wherein movement of the push pin is controlled by rotation of a collar threadedly mounted to threads on an external surface of the mounting block.

In Example 39, the subject matter of Example 38 is further configured wherein the collar is configured to rotate about an axis that is not parallel with respect to the longitudinal axis of the push pin.

In Example 40, the subject matter of Example 39 is further configured wherein the collar moves along the mount block coaxial with the longitudinal axis of the receiver and the push pin moves coaxial with a longitudinal axis of the tank.

Example 41 is a projectile launcher that includes a barrel defining a longitudinal bore dimensioned to receive a projectile and a receiver including a breech proximate the barrel. The launcher is a valve assembly configured to selectively vent a source of compressed gas into the breech to propel a projectile out of the barrel. A firing assembly is provided that is configured to actuate the valve assembly responsive to a trigger pull. In some embodiments, the barrel includes rifling defining a plurality of grooves configured to impart spin on projectiles moving through the barrel and a plurality of ports, wherein the plurality of ports are aligned with grooves of rifling.

In Example 42, the subject matter of Example 41 is configured wherein the plurality of grooves are curved between a muzzle end and a chamber end of the barrel and the ports are aligned with the curvature of the grooves.

What is claimed is:

1. A projectile launcher comprising:

a barrel defining a longitudinal bore dimensioned to receive a projectile;

a receiver including a breech proximate the barrel, wherein the receiver includes a grip portion defining an opening dimensioned to receive a compressed gas cartridge, wherein the receiver includes a gas transfer mechanism configured to pierce a seal of the compressed gas cartridge disposed in the opening;

a valve assembly configured to be in fluid communication with the gas transfer mechanism, wherein the valve assembly is configured to selectively vent a source of compressed gas into the breech to propel a projectile out of the barrel;

a firing assembly configured to actuate the valve assembly responsive to a trigger pull;

a selector assembly operatively connected with the grip portion, wherein the selector assembly includes a door movable between an open position that allows the compressed gas cartridge to be removed from the opening, a closed position that retains the compressed gas cartridge in the opening, and an activation position where the door cooperates with the gas transfer mechanism to pierce the seal in the compressed gas cartridge;

wherein the door comprises a proximal end pivotally connected to the grip portion and a distal end extending from the proximal end; and wherein the distal end of the door moves further into the opening in the grip portion when in the activation position.

2. The projectile launcher of claim 1, wherein the distal end of the door includes a magnetically attracted material and the selector assembly includes a magnet to retain the door in the closed position.

3. The projectile launcher of claim 2, wherein the magnet is spring-loaded to urge the distal end of the door from the activation position to the closed position.

4. The projectile launcher of claim 3, wherein a force applied to the distal end of the door overcomes the spring-loaded magnet such that the door moves the compressed gas cartridge towards the gas transfer mechanism to pierce the seal.

5. The projectile launcher of claim 4, wherein the selector assembly is configured to latch the door in the closed position with a force less than a sufficient force to move the spring-loaded magnet due to the magnetic coupling between the magnet and the door.

6. The projectile launcher of claim 5, wherein the door includes a low friction surface configured to engage the compressed gas cartridge when the door moves from the closed position to the activation position.

7. The projectile launcher of claim 6, wherein the low friction surface is a roller.

8. The projectile launcher of claim 1, wherein the door is movable to a venting position where the door retains the compressed gas cartridge in the opening, but spaced apart from the gas transfer mechanism to vent any residual gas in the cartridge out of the opening.

9. The projectile launcher of claim 8, wherein the door is configured to pivot away from the gas transfer mechanism when moving between the closed position to the venting position.

10. The projectile launcher of claim 9, wherein the door is configured to be biased away from the open position to the venting position to prevent residual gas in the cartridge from driving the cartridge out of the opening in the grip.

11. A projectile launcher comprising:

a barrel defining a longitudinal bore dimensioned to receive a projectile;

a receiver including a breech proximate the barrel, wherein the receiver includes an opening dimensioned to receive a compressed gas cartridge, wherein the receiver includes a gas transfer mechanism configured to pierce a seal of the compressed gas cartridge disposed in the opening;

a valve assembly configured to be in fluid communication with the gas transfer mechanism, wherein the valve assembly is configured to selectively vent a source of compressed gas into the breech to propel a projectile out of the barrel;

a firing assembly configured to actuate the valve assembly responsive to a trigger pull;

a selector assembly including a door pivotal between an open position, a closed position and an activation position for selectively retaining the compressed gas cartridge in the opening, wherein the selector assembly includes at least one magnet for retaining the compressed gas cartridge in the opening without piercing the seal when a force applied to the door is less than a predetermined force in the closed position and to pierce the seal when a force greater than the predetermined force is applied to the door in the closed position; and wherein the at least one magnet is spring-loaded, and the predetermined force overcomes the urging on the magnet to allow the door to move to the activation position.

12. A method of operating a projectile launcher, the method comprising the steps of:

pivoting a door covering an opening in a grip of a projectile launcher to an open position that provides access to the opening;

inserting a compressed gas cartridge into the opening in the grip;

pivoting the door to a closed position with a first force to retain the compressed gas cartridge in the opening, wherein the first force is insufficient to move the door to an activation position that pierces the compressed gas cartridge; and applying a second force to the door to pivot the door past the closed position to the activation position that pierces the compressed gas cartridge, wherein the second force is greater than the first force.

13. The method of claim 12, further comprising the step of pivoting the door to a venting position in which the door retains the compressed gas cartridge in a position that allows residual gas to be vented.

14. The method of claim 13, further comprising the step of pivoting the door from the venting position and the open position and removing the compressed gas cartridge.

15. The method of claim 14, wherein the door is retained in the closed position via a magnetic connection.

* * * * *